US006460348B2

(12) United States Patent
Okamura et al.

(10) Patent No.: US 6,460,348 B2
(45) Date of Patent: Oct. 8, 2002

(54) REGENERATOR AND COLD ACCUMULATION REFRIGERATOR USING THE SAME

(75) Inventors: Masami Okamura; Tomohisa Arai, both of Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/813,879

(22) Filed: Mar. 22, 2001

(65) Prior Publication Data

US 2001/0025494 A1 Oct. 4, 2001

(30) Foreign Application Priority Data

Mar. 24, 2000 (JP) ..... 2000-085347

(51) Int. Cl.[7] ..... F25B 6/00
(52) U.S. Cl. ..... 62/6
(58) Field of Search ..... 62/6; 165/4, 10

(56) References Cited

U.S. PATENT DOCUMENTS 5,339,653 A * 8/1994 Degregoria ..... 62/467
5,593,517 A * 1/1997 Saito et al. ..... 148/301

FOREIGN PATENT DOCUMENTS

JP 61-228264 10/1986

* cited by examiner

*Primary Examiner*—William C. Doerrler
*Assistant Examiner*—Malik N. Drake
(74) *Attorney, Agent, or Firm*—Foley & Lardner

(57) ABSTRACT

A regenerator comprises a regenerator body and cold accumulating material packed in the regenerator body in which cooling medium gas flows from one end portion of the regenerator body to the other end portion of the regenerator body so as to obtain a lower temperature, wherein at least part of the cold accumulating material is a plate-shaped cold accumulating material having a thickness of 0.03–2 mm. In the above structure, it is preferable that the cold accumulating material is composed of an alloy containing 10 at % or more of rare earth element and that a length of the plate-shaped cold accumulating material in a flowing direction of the cooling medium gas is 1–100 mm. According to the above structure, there can be provided a regenerator (cold accumulating unit) and a refrigerator using the regenerator which is free from being finely pulverized, and is excellent in workability and durability, and capable of exhibiting a significant refrigerating performance at low temperature range for a long period of time in a stable condition.

18 Claims, 11 Drawing Sheets

REGENERATOR AND COLD ACCUMULATION REFRIGERATOR USING THE SAME

BACKGROUND OF THE INVENTION

1. Field of the Invention

The present invention relates to a regenerator (cold accumulating unit) filled with a cold accumulating material and a cold accumulating type refrigerator using the regenerator, and more particularly to a regenerator of which cold accumulating material is free from the risk of being pulverized into fine particles, and is excellent in workability and durability, and exhibits significant refrigerating performance at a low temperature region, and relates to a cold accumulation refrigerator using the regenerator (cold accumulating unit).

2. Description of the Related Art

Recently, superconductivity technology has been progressed remarkably and with an expanding application field thereof, development of a small, high performance refrigerator has become indispensable. For such a refrigerator, light weight, small size and high heat efficiency are demanded, and a small-sized refrigerator has been practically applied to various industrial fields.

For example in a super-conductive MRI apparatus, cryopump and the like, a refrigerator based on such refrigerating cycle as Gifford MacMahon type (GM refrigerator), Starling method, pulse-tube type refrigerator has been used. Further, a magnetic floating (levitating) train absolutely needs a high performance refrigerator for generating magnetic force by using a super-conductive magnet. Further, in recent years, a super-conductive power storage apparatus (SMES) or an in-magnetic-field single crystal pull-up apparatus (magnetic field applied Czochralski) has been provided with a high performance refrigerator as a main component thereof.

In the above described refrigerator, the operating medium such as compressed He gas or the like flows in a specified direction in a regenerator (cold accumulating unit) filled with cold accumulating materials so that the heat energy thereof is supplied to the cold accumulating material. Then, the operating medium expanded here flows in an opposite direction and receives heat energy from the cold accumulating material. As the recuperation effect is improved in this process, the heat efficiency in the operating medium cycle is improved so that a further lower temperature can be realized.

As a cold accumulating material for use in the above-described refrigerator, conventionally Cu, Pb and the like have been used. However, these cold accumulating materials have a very small specific heat in extremely low temperatures below 20K. Therefore, the aforementioned recuperation effect is not exerted sufficiently, so that even if the refrigerator is cyclically operated under an extremely low temperature, the cold accumulating material cannot accumulate sufficient heat energy, and it becomes impossible for the operating medium to receive the sufficient heat energy. As a result, there is posed a problem of that the refrigerator in which the regenerator (cold accumulating unit) filled with aforementioned cold accumulating material is assembled cannot realize the extremely low temperatures.

For the reason, recently to improve the recuperation effect of the regenerator at extremely low temperature and to realize temperatures nearer absolute zero, use of magnetic cold accumulating material made of intermetallic compound formed from a rare earth element and transition metal element such as $Er_3Ni$, ErNi, $ErNi_2$, $HoCu_2$ having a local maximum value of volumetric specific heat and indicating a large volumetric specific heat in an extremely low temperature range of 20K or less has been considered. By applying the magnetic cold accumulating material t o the GM refrigerator, a refrigerating operation to produce an arrival lowest temperature of 4k is realized.

The magnetic cold accumulating material described above is normally worked and used in a form of spherical-shape having a diameter of about 0.1–0.5 mm for the purpose of effectively performing the heat exchange with He gas as cooling medium in the refrigerator. In particular, in a case where the magnetic cold accumulating material (particulate cold accumulating substance) is intermetallic compound containing rare earth element, the particulate cold accumulating substance is worked so as to have a spherical-shape in accordance with working methods such as centrifugal atomizing method.

However, in a Starling-type refrigerator and a pulse-tube type refrigerator or the like to be operated with a high speed, there has been posed a problem that a pressure loss at the regenerator packed with spherical magnetic cold accumulating particles is disadvantageously increased, so that a sufficient refrigerating capacity cannot be realized. Further, in the GM refrigerator or the like, there has been liable to cause the following disadvantages. Namely, vibration and impact force are applied to the magnetic body particles (magnetic cold accumulating particles) during the operation of the refrigerator and the magnetic particles were liable to be further finely pulverized, so that a flow resistance of the cooling medium gas is increased thereby to abruptly lower the heat exchange efficiency.

To cope with these problems, as samples of structure of cold accumulating material for lowering the pressure loss of the cooling medium gas, there has been proposed: a cold accumulating material composed of a punching plate formed by punching a magnetic material plate so as to form a number of through holes through which the cooling medium gas flows; a cold accumulating material composed of a rolled ribbon formed by winding a magnetic material ribbon; and a cold accumulating material composed of a screen formed by laminating a plurality of net-shaped magnetic materials.

However, since the cold accumulating materials described above exhibit a brittleness peculiar to the intermetallic compound, there had been raised a problem such that it was difficult to punch, bend or drill the materials, and it was extremely difficult to work the materials to have the above shapes, and the materials required an enormous large amount of working cost.

SUMMARY OF THE INVENTION

The present invention has been achieved to solve the above described problems and an object of the invention is to provide a regenerator (cold accumulating unit) filled with cold accumulating material which is free from the fear of being finely pulverized, and is excellent in workability and durability, and capable of exhibiting a significant refrigerating performance at an extremely low temperature range for a long period of time in a stable condition, and provide a cold accumulation refrigerator using the same.

In addition, another object of the present invention is to provide an MRI apparatus, a super-conducting magnet for magnetic floating train, a cryopump and an in-magnetic field single crystal pull-up apparatus capable of exerting an excellent performance for a long period of time by using the aforementioned cold accumulation refrigerator.

To achieve the above objects, the regenerator (cold accumulating unit) of the present invention comprises a regenerator body and cold accumulating material packed in the regenerator body in which cooling medium gas flows from one end portion of the regenerator body to the other end portion of the regenerator body so as to obtain a lower temperature, wherein at least part of the cold accumulating material is a plate-shaped cold accumulating material having a thickness of 0.03–2 mm.

Further, in the above structure, it is preferable that the cold accumulating material is composed of an alloy containing 10 at % or more of rare earth element, and that a length of the plate-shaped cold accumulating material in a flowing direction of the cooling medium gas is set to 1–100 mm. In addition, it is also preferable that a plurality of the plate-shaped cold accumulating material are arranged in a direction normal to the cooling medium gas flowing direction so as to form gaps therebetween, and a width of the gap is 0.01–1 mm.

Furthermore, in the above regenerator (cold accumulating unit), it is preferable to constitute the regenerator so that grooves are formed to an inner surface of the regenerator body, and a peripheral portion of the plate-shaped cold accumulating material is inserted in the groove. In addition, it is also preferable that projections are formed to an inner surface of the regenerator body, and a peripheral portion of the plate-shaped cold accumulating material is inserted into a portion between the projections. Further, it is also preferable that a plurality of the plate-shaped cold accumulating materials are fixed by a retainer, and the retainer is inserted in the regenerator body. Furthermore, it is also preferable that a plurality of the plate-shaped cold accumulating materials are arranged in a cooling medium gas flowing direction, and an angle constituted by a plane surface of the plate-shaped cold accumulating material and a plane surface of an adjacent plate-shaped cold accumulating material arranged in a cooling medium gas flowing direction is set to 0.5° or more in a radial direction of the regenerator.

In addition, as a special construction of a regenerator (cold accumulating unit), the regenerator can be also constituted such that a plurality of the plate-shaped cold accumulating materials are arranged so as to partition a cross sectional area of a flowing passage of the cooling medium gas thereby to form a plurality of cells through which the cooling medium gas flows. In the above structure, it is preferable that the cold accumulating material forming the cell has an average thickness of 0.05–2 mm. Further, it is also preferable that a plurality of the cells have an average cross-sectional area of $1\times10^{-9}$ $m^2$ to $2\times10^{-6}$ $m^2$. Furthermore, it is also preferable that a plurality of the cells have an average length of 3 mm to 100 mm.

In addition, it is also preferable that a plurality of the plate-shaped cold accumulating materials and the cells are formed through an extrusion of a mixture comprising a binder and cold accumulating material powder. In this case, it is preferable that the cold accumulating material powder contains 10 at % or more of rare earth element.

The cold accumulation refrigerator of the present invention is characterized by comprising a regenerator (cold accumulating unit) filled with a cold accumulating material through which a cooling medium gas flows from a high temperature-upstream side of the regenerator, so that heat is exchanged between the cooling medium gas and the cold accumulating material thereby to obtain a lower temperature at a downstream side of the regenerator, wherein at least part of the regenerator (cold accumulating unit) is composed of the regenerator as described above.

Each of the MRI (Magnetic Resonance Imaging) apparatus, superconducting magnet for the magnetic floating train, cryopump and in-magnetic field single crystal pull-up apparatus (magnetic field applied Czochralski) according to the present invention is characterized by comprising the cold accumulation refrigerator as described above.

It is preferable that at least part of the cold accumulating material to be packed in the regenerator body of this invention is formed of a magnetic alloy containing 10 at % (atomic %) or more of rare earth element.

To put it concretely, for example, it is preferable that the alloy constituting the cold accumulating material consists of a simple substance of rare earth element or intermetallic compound expressed by a general formula:

$$RM_z \tag{1}$$

wherein R denotes at least one of rare earth element selected from the group consisting of Y, La, Ce, Pr, Nd, Pm, Sm, Eu, Gd, Tb, Dy, Ho, Er, Tm and Yb, while M denotes at least one element selected from the group consisting of Ni, Co, Cu, Ag, Al, Ru, In, Ga, Ge, Si and Rh, and z in atomic ratio satisfies a relation: $0\leqq z\leqq 9.0$.

As is clear from the general formula (1) of RMz ($0\leqq z\leqq 9.0$), the cold accumulating material to be packed in the regenerator (cold accumulating unit) of the present invention is preferably constituted by magnetic substances such as a single substance of rare earth element or intermetallic compound containing rare earth element. In this regard, other than the magnetic substances described above, the cold accumulating material constituted by metallic materials such as Pb, Pb alloy, Cu, Cu alloy, stainless steel or the like can be also used together with the aforementioned magnetic substances.

In the general formula described above, R component denotes at least one of rare earth element selected from the group consisting of Y, La, Ce, Pr, Nd, Pm, Sm, Eu, Gd, Tb, Ho, Dy, Er, Dy, Tm and Yb, while M component denotes at least one element selected from the group consisting of Ni, Co, Cu, Ag, Al, Ru, In, Ga, Ge, Si and Rh.

When a mixing ratio z of M component with respect to R component exceeds 9.0, a proportion of rare earth element as magnetic element is remarkably lowered thereby to reduce the specific heat of the cold accumulating material. In this regard, in case of z=0, i.e. the cold accumulating material is composed of single substance of rare earth element, it is difficult to control the temperature exhibiting a high specific heat, so that the cold accumulating material is preferably composed of intermetallic compound containing rare earth element.

A preferable range of z is $0.1\leqq z\leqq 5$, and more preferably be $1\leqq z\leqq 3$. Particularly preferable concrete compositions may include $Er_3Ni$, $Er_3Co$, ErNi, $ErNi_{0.9}Co_{0.1}$, $HoCu_2$, $ErIn_3$, HoSb, $Ho_2Al$. In the above compositions as like $ErNi_{0.9}Co_{0.1}$ which is prepared by substituting Co for a part of Ni of ErNi, when a part of R component is substituted for at least one element of the other R component, or when a part of M component is substituted for at least one element of the other M component, it becomes possible to shift a temperature position of the volumetric specific heat peak of the magnetic substance, and to control a width of the specific heat peak so as to realize a specific heat which is effective as the cold accumulating material.

The cold accumulating material used in the present invention may be constituted by a molded body composed of a number of magnetic particles mainly comprised of oxide having a specific heat peak at an extremely low temperature region of 20K or less. As examples of the oxides constituting the magnetic particle, for example, the compositions having the following general formulas of (2), (3), (4) and (5) can be preferably used.

That is, there can be used: a perovskite type oxide expressed by a general formula of $$RM'_2O_3 \quad (2)$$

wherein R denotes at least one of rare earth element selected from the group consisting of Y, La, Ce, Pr, Nd, Pm, Sm, Eu, Gd, Tb, Dy, Ho, Er, Tm and Yb, while M' denotes at least one element selected from 3B family elements in the long-periodic table;

a spinel type oxide expressed by a general formula of $$AB_2O_4 \quad (3)$$

wherein A denotes at least one element selected from 2B family elements, while B denotes at least one element selected from transition metal elements containing at least of Cr;

an oxide expressed by a general formula of $$CD_2O_6 \quad (4)$$

wherein C denotes at least one element selected from Mn and Ni, while D denotes at least one element selected from Nb and Ta; and an oxide expressed by a general formula of $$Gd_{1-x}R_xA_{1-y}B_yO_3 \quad (5)$$

wherein R denotes at least one of rare earth element selected from the group consisting of Ce, Pr, Nd, Pm, Sm, Tb, Dy, Ho and Er, while A denotes at least one element selected from the group consisting of Ti, V, Cr, Mn, Fe, Co, Ni, Cu, Zn, Ga, Ge, Al and Si, at least two elements being selected as A component in a case of x=0 and y=0, while at least one element being selected as A component in a case of x 0 or y 0, B denotes at least one element selected from the group consisting of Zr, Nb, Mo, Ag, In, Sn, Sb, Hf, Ta, W, Au, and Bi, and x in atomic ratio satisfies a relation: $0 \leqq x \leqq 0.4$, while y in atomic ratio satisfies a relation: $0 \leqq x \leqq 0.4$.

Regarding the general formula (5) of $Gd_{1-x}R_xA_{1-y}B_yO_3$, in a case of x=0 and y=0, the general formula (5) can be expressed by a formula of $GdAO_3$. In this oxide composition of $GdAO_3$, however, when the A component is composed of a single element, there can be generally obtained a magnetic body having a specific heat at an extremely low temperature region, while the magnetic body rarely exhibits a high specific heat at the extremely low temperature range of 4–6 K. Therefore, in a case of x=0 and y=0, at least two elements are selected as A component. On the other hand, when a part of Gd is substituted for the other rare earth element, or when a part of A component is substituted for the other element, it becomes possible to control the specific heat characteristics of the magnetic body thereby to obtain a cold accumulating material having an excellent performance.

In the above general formula (5) of a general formula of $Gd_{1-x}R_x A_{1-y} B_yO_3$, R component denotes at least one of rare earth element selected from the group consisting of Ce, Pr, Nd, Pm, Sm, Tb, Dy, Ho and Er, and R is an effective component for broadening a sharpened specific heat peak and controlling the position of the peak temperature. The R component is added so as to substitute a part of Gd. When the addition ratio x indicating the substituting amount of R component exceeds 0.4, the specific heat of the magnetic body is disadvantageously lowered. Among the above R component, Tb, Dy, Ho and Er are preferable, and Tb and Dy are more preferable.

Further, A component denotes at least one element selected from the group consisting of Ti, V, Cr, Mn, Fe, Co, Ni, Cu, Zn, Ga, Ge, Al and Si, and has an effect of controlling the peak of specific heat. At least two elements are selected in a case of x=0 and y=0, while at least one element is selected in a case of x 0 or y 0, so that a part of Gd or A component in $GdAO_3$ type magnetic body is invariably substituted for the other element. Among the above a component elements, of Ti, V, Cr, Mn, Fe, Co, Ni, Ga and Al are preferable, and Cr, Mn, Fe, Co, Ni, Ga and Al are more preferable.

Furthermore, B component is an element for improving the specific heat characteristic by the function of controlling a distance between atoms of $(Gd_{1-x}R_x)$ when B component is substituted for a part of A component. The B component denotes at least one element selected from the group consisting of Zr, Nb, Mo, Ag, In, Sn, Sb, Hf, Ta, W, Au and Bi. As the B component element, Zr, Nb, Mo, Sn, Ta and W are preferable, and Ta and W are more preferable. When the addition ratio y indicating the addition amount of B component exceeds 0.4, it becomes impossible to maintain the perovskite structure, so that the specific heat characteristics of the cold accumulating material composed of the magnetic body is disadvantageously lowered.

Furthermore, there may be a case where the atomic ratio of oxygen in the above general formula: $Gd_{1-x}R_x A_{1-y} B_yO_3$ is deviated from a stoichiometric ratio of 3 due to atomic defectives or the like. However, if the atomic ratio of oxygen is within a range of 2.5–3.5, the above deviation has not a great influence on the specific heat characteristic of the magnetic body.

A method of manufacturing the plate-shaped cold accumulating material to be packed in the regenerator (cold accumulating unit) of the present invention is not specifically limited. For example, a working method in which an alloy ingot of a cold accumulating material having the above composition is cut and sliced by means of cutting tool such as a blade saw or the like, or a powder-sintering method or the like can be used.

Further, in a case of a cold accumulating material formed with a plurality of cells through which a cooling medium gas flows, such the cold accumulating material can be formed through an extrusion of a mixture of cold accumulating material powder and a binder, as described later.

BRIEF DESCRIPTION OF THE DRAWINGS

FIG. 10A–FIG. 10D are cross sectional views each showing a cross sectional view of a cell formed in a cold accumulating material: in which FIG. 10A is a cross sectional view showing a triangular-shaped cell; FIG. 10B is a cross sectional view showing a rectangular-shaped cell; FIG. 10C is a cross sectional view showing a hexagonally-shaped cell; and FIG. 10D is a cross sectional view showing a circular-shaped cell.

DESCRIPTION OF THE PREFERRED EMBODIMENTS

Next, the preferred embodiments of the present invention will be described with reference to the accompanying drawings.

Figure 1:
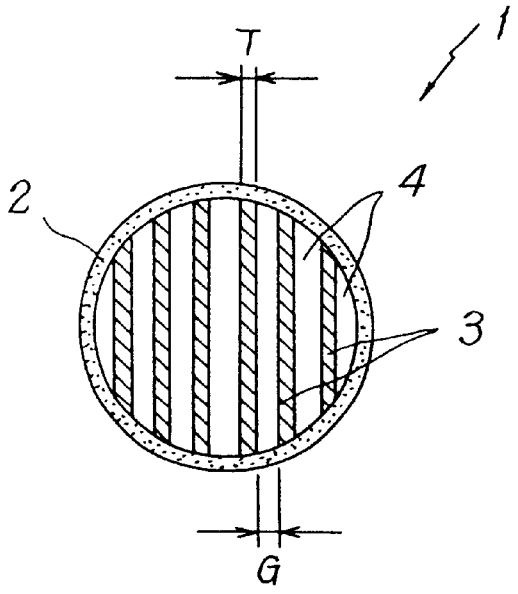
FIG. 1 is a cross sectional view showing one embodiment of a regenerator (cold accumulating unit) according to the present invention.
Figure 2:
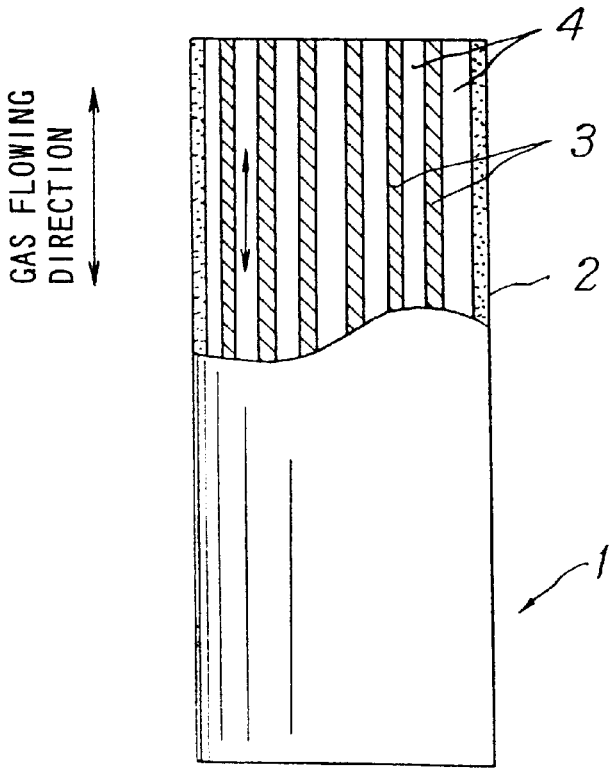
FIG. 2 is a front view partially broken, showing the regenerator (cold accumulating unit) shown in FIG. 1.

As shown in FIGS. 1 and 2, for example, a regenerator (cold accumulating unit) 1 of the present invention is formed in such a manner that a plurality of plate-shaped cold accumulating materials 3 are arranged in a cylindrical regenerator body 2 so that the plurality of the plate-shaped cold accumulating materials are fixed in a direction normal to a cooling gas flowing passage 4 so as to leave a predetermined space (gap) G therebetween.

A thickness T of the plate-shaped cold accumulating material 3 to be packed in the regenerator 1 of the present invention is one factor exerting a great influence on a cold accumulating characteristic of a refrigerator, so that the thickness T is set to a range of 0.03–2 mm in the present invention. When the thickness T of the cold accumulating material 3 is excessively less than 0.03 mm, a structural strength of the cold accumulating material becomes insufficient, so that the cold accumulating material is liable to be broken during an assembling of the regenerator (cold accumulating unit) 1, and is liable to be broken due to vibration caused during the operation of the refrigerator.

On the other hand, when the thickness T of the cold accumulating material 3 is excessively larger than 2 mm, a heat-penetration into an inner deep portion of the cold. accumulating material 3 during one refrigerating cycle becomes insufficient, thereby to lower the cold accumulating efficiency. Therefore, the thickness T of the cold accumulating material 3 is set to the range of 0.03–2 mm in the present invention. However, a range of 0.2–1.3 mm is more preferable and a range of 0.4–1.0 mm is particularly preferable.

Figure 3:
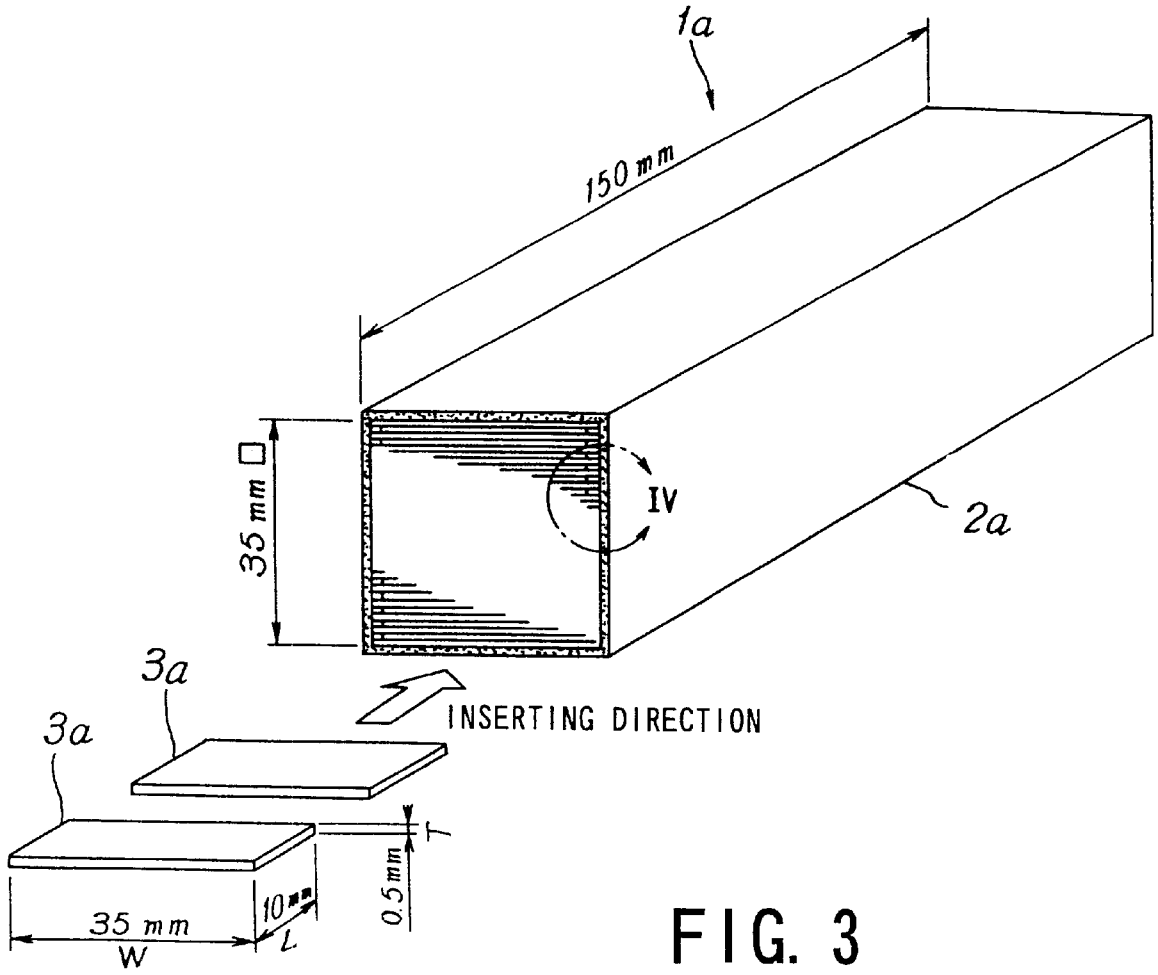
FIG. 3 is a perspective view showing another embodiment of a regenerator (cold accumulating unit) according to the present invention.
Figure 4:
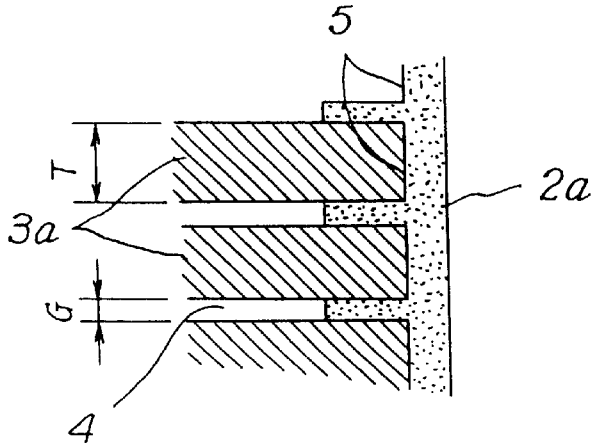
FIG. 4 is a partially enlarged view of IV portion shown in FIG. 3.

Further, as exemplarily shown in FIGS. 3 and 4, in a regenerator (cold accumulating unit) 1*a* of the present invention, it is preferable that a length L of the plate-shaped cold accumulating material 3*a* in a cooling medium gas (He gas) flowing is set to a range of 1–100 mm in the present invention. When the length L of the plate-shaped cold accumulating material 3*a* is excessively short to be less than 1 mm, it requires much manpower for packing the short cold accumulating material 3*a* into the regenerator body 2*a* having a long length in a cooling medium gas flowing direction, until the regenerator body 2*a* is filled with the short cold accumulating material 3*a*, thus being not preferable in view of a productivity of the regenerator (cold accumulating unit).

On the other hand, when the length L of the plate-shaped cold accumulating material 3*a* is excessively long to exceed 100 mm, a heat-conduction amount in a direction of the cooling medium gas flowing passage is increased, and the heat is liable to flow into a low-temperature side end portion of the refrigerator thereby to lower the refrigerating capacity. Therefore, the length L of the plate-shaped cold accumulating material 3*a* in a flowing direction of the cooling medium gas is set to the range of 1–100 mm in the present invention. However, a range of 5–40 mm is more preferable and a range of 8–20 mm is particularly preferable.

Namely, when a case where the long cold accumulating materials 3 extending to an entire length of the regenerator (cold accumulating unit) 1 in a flowing direction of the cooling medium gas are arranged as shown in FIGS. 1 and 2 is compared with a case where a plurality of the short cold accumulating materials 3*a* are arranged so as to be lined up in a flowing direction of the cooling medium gas as shown in FIGS. 3 and 4, the latter case becomes possible to further increase the refrigerating capacity, because a break or discontinuity formed between the adjacent cold accumulating materials 3*a* exhibits an effect of suppressing the above heat-conduction.

Furthermore, for example, as shown in FIGS. 1 and 4, in the regenerator (cold accumulating unit) 1 of the present invention, a width of gap G formed between the plurality of the plate-shaped cold accumulating materials 3, 3*a* arranged in a direction normal to the cooling medium gas flowing direction is preferably set to a range of 0.01–1 mm. When the width of the gap G formed between the plate-shaped cold accumulating materials 3, 3*a* is excessively small to be less than 0.01 mm, a flow resistance of the cooling medium gas in the gas flowing passage 4 is disadvantageously increased thereby to lower the refrigerating capacity.

On the other hand, when the width of the gap G formed between the cold accumulating materials 3, 3*a* is excessively large to exceed 1 mm, a packing rate of the cold accumulating materials 3, 3*a* is lowered and heat-exchanging between the cooling medium gas and the cold accumulating materials 3, 3*a* becomes insufficient, thereby to lower the refrigerating capacity. Therefore, the width of the gap G of the plate-shaped cold accumulating materials is preferably set to the range of 0.01–1 mm in the present invention. However, a range of 0.02–0.3 mm is more preferable and a range of 0.05–0.15 mm is particularly preferable.

In the regenerator (cold accumulating unit) of the present invention, a fixing structure of the respective cold accumulating materials with respect to the regenerator body is not particularly limited. However, the following fixing structures are preferable. For example, as shown in FIG. 4, the regenerator (cold accumulating unit) can be formed in such a manner that a peripheral portion of each of the plate-shaped cold accumulating materials 3*a* is inserted into a groove 5 formed to an inner wall of the regenerator body 2*a* thereby to fix the respective cold accumulating materials 3*a*. In this case, a thickness of a projection forming the groove 5 constitutes the gap G formed between the adjacent cold accumulating materials 3*a*, 3*a* thereby to form the cooling medium gas passage (cell) 4. In this connection, if a lubricant such as grease or the like is previously coated onto the above groove 5 before the plate-shaped cold accumulating material 3*a* is inserted, the inserting operation can be smoothly performed.

Figure 6:
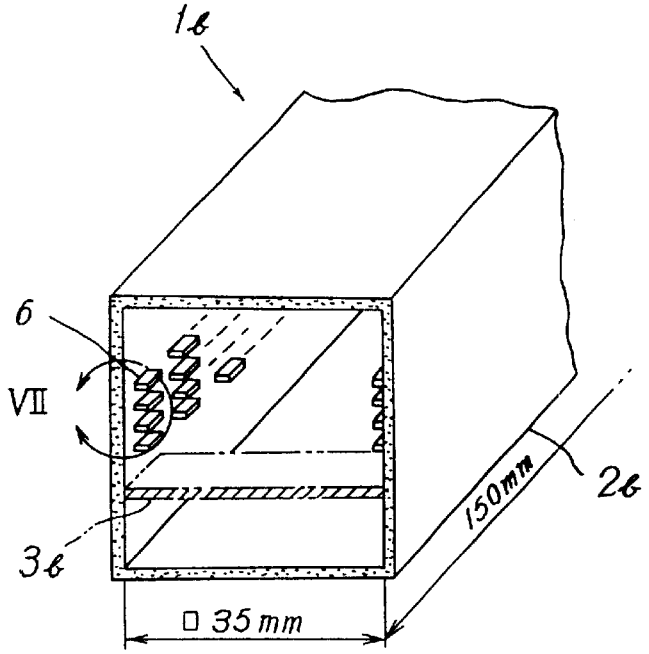
FIG. 6 is a perspective view showing still another embodiment of a regenerator (cold accumulating unit) according to the present invention.
Figure 7:
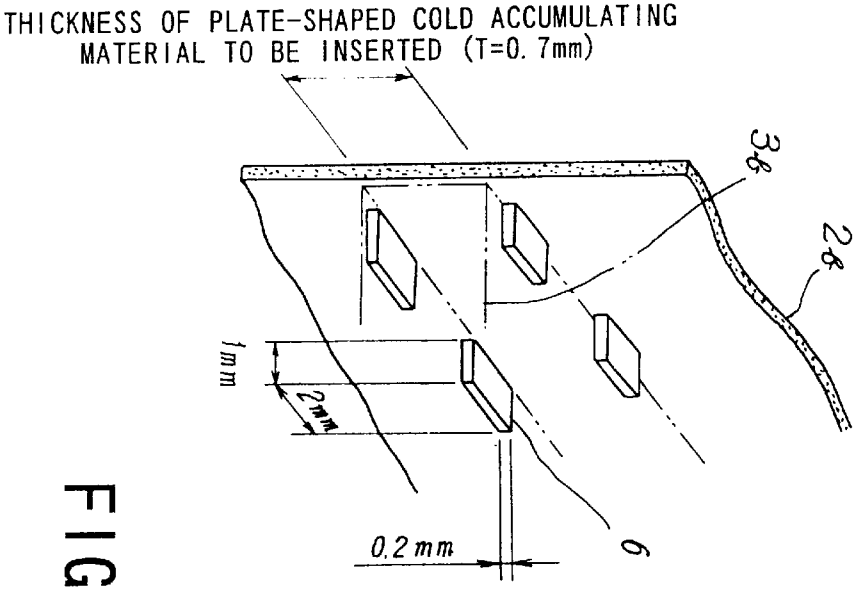
FIG. 7 is an enlarged perspective view of VII portion shown in FIG. 6.

Further, as another fixing structure of the plate-shaped cold accumulating material, for example, a structure shown in FIGS. 6 and 7 can be also adopted. That is, a regenerator (cold accumulating unit) 1*b* shown in FIGS. 6 and 7 has a fixing structure in which projections 6 are formed to the inner wall of the regenerator body 2*b* and a peripheral portion of each of the plate-shaped cold accumulating materials 3*b* is inserted into a portion between the projections 6, 6 thereby to fix the respective cold accumulating materials 3*b*. In this case, a thickness of the projection 6 constitutes the gap formed between the adjacent cold accumulating materials 3*b*, 3*b* whereby the gap forms the cooling medium gas passage (cell). A shape of the projection 6 is not particularly limited, and various shapes such as claw shape, button shape, rod shape or the like can be also adopted. In addition, the projections can be also formed on a surface of the plate-shaped cold accumulating material.

Figure 8:
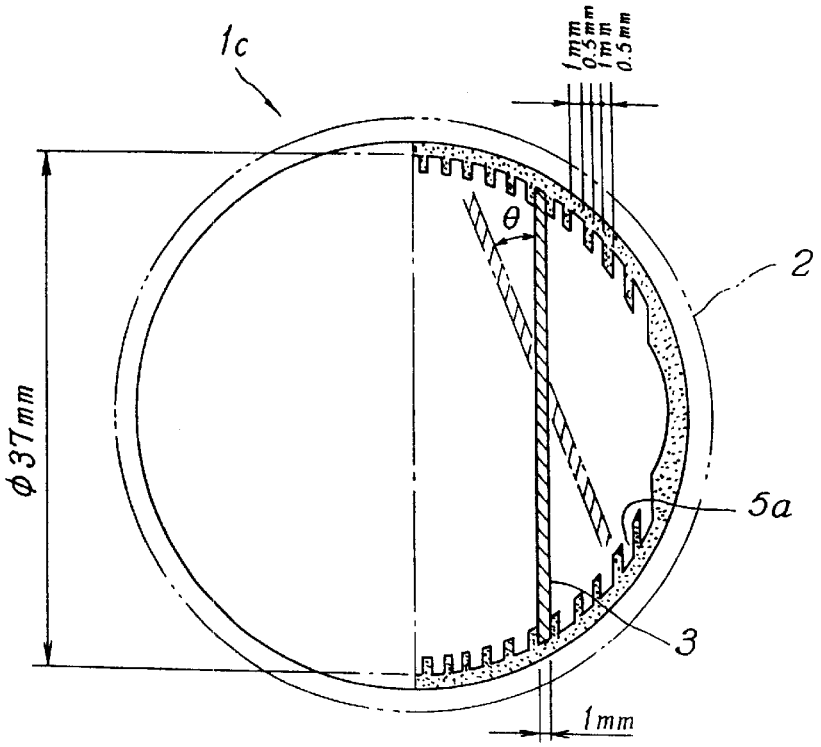
FIG. 8 is a view half in section showing still another embodiment of a regenerator (cold accumulating unit) according to the present invention.
Figure 9:
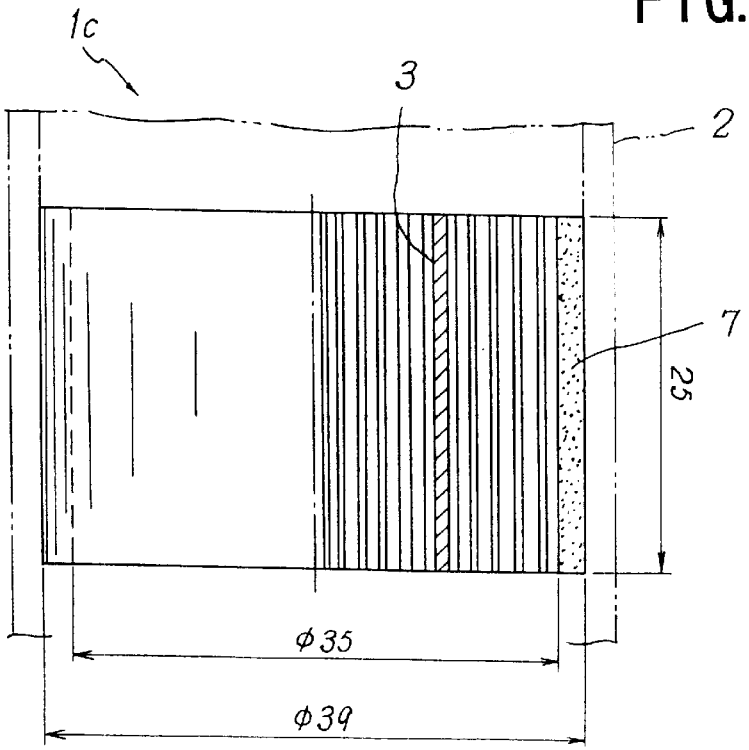
FIG. 9 is a cross sectional view in a longitudinal direction of the regenerator (cold accumulating unit) shown in FIG. 8.

Furthermore, as a still another fixing structure of the plate-shaped cold accumulating materials, for example, a structure shown in FIGS. 8 and 9 can be also adopted. That is, there is prepared a retainer 7 capable of being fit into the regenerator body 2 and the retainer 7 is formed with a number of grooves 5*a* at an inner surface thereof in an axial direction. A plurality of the plate-shaped cold accumulating materials 3 may be fixed to the retainer 7 by inserting the peripheral portion of the plate-shaped cold accumulating material into the groove 5*a*. The above fixing structure is not a structure in which the cylindrical cold accumulating unit body 2 per se is worked and the plate-shaped cold accumulating material is directly fixed to the worked portion.

Namely, it is also possible to form a regenerator (cold accumulating unit) through a method comprising the steps of: previously preparing a retainer 7 composed of a material which is the same as that of the regenerator body or different from that of the regenerator body; fixing a plurality of the plate-shaped cold accumulating materials 3 into the retainer 7 so as to maintain a predetermined gap between the adjacent cold accumulating material; and inserting a plurality of thus formed retainers 7 into the regenerator body 2 in an axial direction thereof.

In this case, a plurality of the plate-shaped cold accumulating materials 3 are previously fixed within the retainer 7. Therefore, when the cold accumulating material 3 is replaced, the replacing work can be completed by only replacing the retainer 7 with new one. Accordingly, the replacing work of the cold accumulating material 3 is completed rapidly, and it becomes easy to handle the cold accumulating material 3, and to prevent the cold accumulating material 3 from being broken.

In addition, in a regenerator (cold accumulating unit) formed by arranging a plurality of plate-shaped cold accumulating materials in a flowing direction of the cooling medium gas, the inventors of the present invention have obtained a knowledge that the heat-exchange function advances more smoothly and the cold accumulating efficiency is more increased in a case where plane plate surfaces of the adjacent cold accumulating materials arranged in a flowing direction of the cooling medium gas are slightly deviated to each other in comparison with a case where the plane plate surfaces of the adjacent cold accumulating materials arranged in a flowing direction of the cooling medium gas exists on the same one surface.

Therefore, as one preferable embodiment of a regenerator (cold accumulating unit) of the present invention, an angle constituted by a plane surface of the plate-shaped cold accumulating material and a plane surface of adjacent plate-shaped cold accumulating material arranged in a cooling medium gas flowing direction is specified to be 0.5° or more in a radial direction of the cold accumulating unit. For example, as shown in FIGS. 8 and 9, in a case a plurality of plate-shaped cold accumulating materials 3 are arranged and fixed in the retainer 7 and thus formed retainers 7 are stacked in a multi-staged form thereby to prepare a regenerator (cold accumulating unit) 1*c*, when the angle è constituted by the plane surface of the plate-shaped cold accumulating material 3 and the plane surface of the adjacent plate-shaped cold accumulating material 3*a* arranged in a cooling medium gas flowing direction is controlled to be 0.5° or more in a radial direction of the regenerator, it becomes possible to control a flow resistance of the cooling medium gas.

When the angle è constituted by the plane surface of the plate-shaped cold accumulating material 3 and the plane surface of the adjacent plate-shaped cold accumulating material 3*a* arranged in a cooling medium gas flowing direction is excessively small to be less than 0.5° in a radial direction of the regenerator (cold accumulating unit), the flow resistance of the cooling medium gas is small and it is difficult to perform a sufficient heat-exchange between the cooling medium gas (operation gas) and the cold accumulating material. Therefore, the angle è constituted by the plane surfaces of the adjacent plate-shaped cold accumulating materials is specified to be 0.5° or more. However, 1° or more is more preferable and 2° or more is particularly preferable.

Further, the regenerator (cold accumulating unit) of the present invention can be also constituted in such a manner that a plurality of the plate-shaped cold accumulating materials are arranged so as to partition a cross sectional area of a flowing passage of the cooling medium gas, thereby to form a plurality of cells through which the cooling medium gas flows.

In the regenerator (cold accumulating unit) having the above structure, an average thickness of the cold accumulating material forming the cell is preferably set to 0.05–2 mm. When the average thickness of the cold accumulating material is less than 0.05 mm, a structural strength of the cold accumulating material becomes insufficient, and it becomes difficult to assemble the cold accumulating materials into the regenerator. In addition, the cold accumulating materials are liable to be broken due to vibrations and shocks caused during the operation of the refrigerator.

On the other hand, when the average thickness of the cold accumulating material exceeds 2 mm, it becomes insufficient for heat to penetrate to an inner portion of the cold accumulating material during one refrigerating cycle, thus lowering the refrigerating efficiency. Therefore, the average thickness of the cold accumulating material as a partition for forming the cell is set to 0.05–2 mm. However, a range of 0.1–1 mm is more preferable and a range of 0.2–0.5 mm is particularly preferable.

In the regenerator (cold accumulating unit) into which the cold accumulating material formed with a plurality of cells is packed, an average cross-sectional area of a plurality of the cells is preferably set to a range of $1\times10^{-9}$ $m^2$ to $2\times10^{-6}$ $m^2$. In this connection, the cross-sectional area of the cell means a cross-sectional area in a direction normal to a flowing direction (axial direction) of the cooling medium gas. When the average cross-sectional area of the cells is less than $1\times10^{-9}$ $m^2$, a flow resistance of the cooling medium gas is increased, so that the refrigerating capacity of the refrigerator using the cold accumulating material is disadvantageously lowered.

On the other hand, when the average cross-sectional area of the cells exceeds $2\times10^{-6}$ $m^2$, a packing ratio of the cold accumulating material to be packed into the regenerator (cold accumulating unit) is lowered and a heat-exchange between the cooling medium gas and the cold accumulating material becomes insufficient, so that the refrigerating capacity of the refrigerator is disadvantageously lowered. Therefore, the average cross-sectional area of a plurality of the cells is set to a range of $1\times10^{-9}$ $m^2$ to $2\times10^{-6}$ $m^2$, however, a range of $2\times10^{-9}$ $m^2$ to $5\times10^{-7}$ $m^2$ is more preferable and a range of $5\times10^{-9}$ $m^2$ to $2\times10^{-7}$ $m^2$ is particularly preferable.

In the regenerator (cold accumulating unit) into which the cold accumulating material formed with a plurality of cells is packed, an average length of a plurality of the cells is preferably set to a range of 3 mm to 100 mm. When the average length of the cells is less than 3 mm, a number of cold accumulating materials are required for filling the cold accumulating unit having a long length in a direction of the cooling medium gas flowing passage, thus complicating the assembling operation of the regenerator (cold accumulating unit), and is not preferable in view of a productivity of the regenerator.

On the other hand, when the average length of the cells exceeds 100 mm, a heat-conduction amount in a direction of the cooling medium gas flowing passage is increased, and the heat is liable to flow into a low-temperature side end portion of the refrigerator thereby to lower the refrigerating capacity. Therefore, the average length of the cells is preferably set to a range of 3–100 mm in the present invention. However, a range of 5–40 mm is more preferable and a range of 8–20 mm is particularly preferable.

A shape of the cross-sectional area of the cell formed to the cold accumulating material is not particularly limited, and various shapes such as triangular, rectangular, hexagonal and circular shape or the like as shown in FIGS. 10 (a)–(d) can be suitably adopted. Further, there can be also adopted a cell shape in which at least two kinds of above shapes of the cross-sectional areas are mixedly formed. Among the above shapes of the cross-sectional area, particularly, when the cell is formed so as to have the rectangular shape or triangular shape in cross-section, the cold accumulating material excellent in mechanical strength and durability can be obtained.

A method of manufacturing the cold accumulating material formed with a plurality of cells and packed in the regenerator (cold accumulating unit) of the present invention is not particularly limited. For example, various forming methods such as extrusion method, corrugate method, emboss method, calendar method or the like can be preferably used. In view of an easiness of the forming operation, it is particularly preferable that a plurality of plate-shaped cold accumulating materials and cells are formed through an extrusion of a material mixture composed of a cold accumulating material powder and a binder. In this regard, it is preferable that the cold accumulating material contains rare earth element at an amount of 10 at % or more.

In the above extrusion method, a cold accumulating material powder (magnetic powder) of which grain size is adequately controlled is prepared. Then, a binder, lubricant agent, surface-active surfactant, water as dispersing medium are added to the cold accumulating material powder, and then uniformly kneaded thereby to prepare a material mixture. Subsequently, the material mixture is supplied to an extrusion machine comprising forming dies such as shaping dies having an extrusion groove for forming a partition constituting an aimed cell-structure. When the material mixture is passed through the forming dies, a molded body having a plurality of cells is formed. Thereafter, the molded body is subjected to a degreasing treatment if necessary, followed by sintering, thereby to form a cold accumulating material having a predetermined cross-sectional shape.

In the above manufacturing method, in order to obtain a cold accumulating material having a high density and a high strength, it is preferable to set an average grain size of the cold accumulating material powder to 10 $\mu$m or less. However, the average grain size of 5 $\mu$m or less is more preferable and the average grain size of 3 $\mu$m or less is particularly preferable. Further, as an example of the binder, for example, methyl cellulose, carboxyl methyl cellulose, polyvinyl alcohol (PVA), starch paste, glycerine, various waxes or the like are preferably used. As the binder, low-melting-point metal materials such as Pb, Sn, In, various solder alloys or the like can be also used.

By the way, for example, there has been conventionally proposed several cold accumulating materials in which cold accumulating material elements subjected to an embossing treatment or cold accumulating material elements formed in a ribbon-shape are wound or stacked thereby to form a dummy cell structure between the adjacent cold accumulating material elements. However, function and effect of a regenerator (cold accumulating unit) using the above conventional cold accumulating material elements are quite different from those of the regenerator (cold accumulating unit) of the present invention.

That is, in the above conventional cold accumulating material, a part of the cold accumulating material movably contacts to each other thereby to form a weak cell. In contrast, the cell in the present invention has a cell structure in which each of the cells is formed by being surrounded by strong and rigid partitions formed integrally. Therefore, in the present invention, due to this cell structure, it becomes possible to stably maintain the shape of each cell against the external forces, thus realizing the stabilization of the characteristics of the refrigerator.

In particular, in a case where the thickness of the partition wall constituting the cell is small, when the above conventional cell structure in which the plate-shaped cold accumulating material elements are mutually contacted is applied, the mechanical strength of the cold accumulating material is insufficient indeed. In contrast, in the present invention, since a plurality of plate-shaped cold accumulating materials are integrally formed so as to provide a frame structure having a high rigidity, it becomes possible to secure a sufficient mechanical strength and a durability.

Further, in the cold accumulating material having the above conventional cell structure, there has been posed a technical problem that a working accuracy cannot attain to a high level, so that a contact of a part of the partition walls constituting the cell becomes insufficient and there may be a case where a gap is liable to be formed between the adjacent partition walls. In this case, the heat-exchange between the cooling medium gas and the cold accumulating material constituting the cell becomes insufficient, thus resulting in a problem of lowering the cold accumulating efficiency. On the other hand, in the cold accumulating material to be used in the regenerator (cold accumulating unit) of the present invention, such the gap would be never formed between the adjacent partition walls, so that the above problem is not raised at all.

As another conventional example, there has been also proposed a cold accumulating material formed by stacking or laminating a plurality of thin plates each composed of magnetic material, the thin plate being provided with a plurality of holes forming a flowing passage of the cooling medium gas, and the holes being formed by means of a mechanical working, an etching treatment, evaporating treatment or the like. However, there have been raised problems such that it is quite difficult to form a plurality of fine holes to a thin plate composed of magnetic material having a high brittleness by means of mechanical working method, and that the working cost is too high to meet industrial requirement.

According to the knowledge of the inventors of this invention, the inventors have conceived a method of manufacturing a cold accumulating material, the method comprising the steps of: preparing a core member composed of a material different from a cold accumulating material; winding the cold accumulating material around the core member; bundling a plurality of the wound cold accumulating materials to form a bundled material; wire-drawing the bundled material to form an integrated material having a reduced size; and removing the core member from the integrated material by etching treatment or evaporation treatment or the like thereby to manufacture a cold accumulating material formed with holes through which the cooling medium gas flows.

Figure 10A:
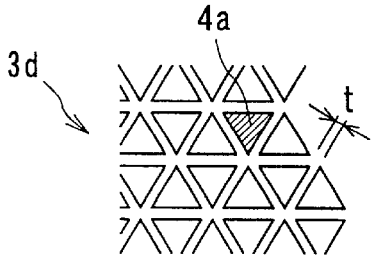
Figure 10B:
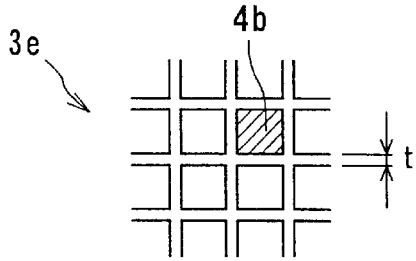

However, in general, it is difficult to wire-draw the magnetic material having a high brittleness and less workability, so that the above manufacturing method cannot be an industrially effective method of manufacturing the cold accumulating material. In addition, according to the above manufacturing method, a cross-sectional shape of the hole is a circle generally. In order to form the hole having a circular-shape in cross-section, the partition wall enclosing the cell is required to be constituted by a curbed surface. In this structure, a partition wall portion having a thin thickness and a partition wall having a large thickness are mixedly formed as shown in FIG. 10D, so that the partition wall portion having a thin thickness is insufficient in structural strength while the partition wall having a large thickness is insufficient in heat-exchanging performance. Therefore, at any rate, there exists a portion at which the characteristics required for the cold accumulating material are disadvantageously lowered.

Figure 10C:
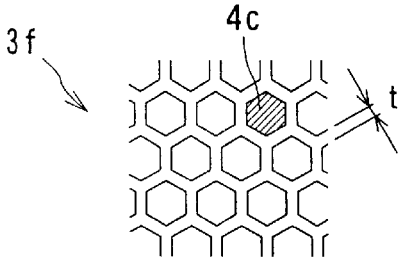
Figure 10D:
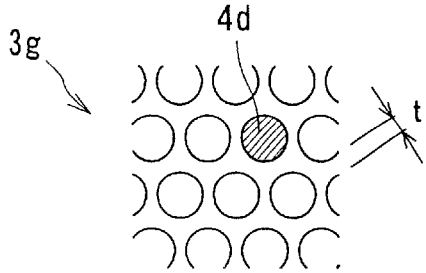

Accordingly, in order to secure both the mechanical characteristics and the improved heat conductivity simultaneously, the cells having a cross-sectional shapes such as triangular, rectangular, and hexagonal shape as shown in FIGS. 10–10C are more preferable than the cell having a circular shape as shown in FIG. 10D.

The cold accumulation refrigerator of the present invention is constructed by using the regenerator (cold accumulating unit), into which the above cold accumulating material is packed, as at least part of the regenerators (cold accumulating units) disposed in the refrigerator. The refrigerator may also be constructed so that the regenerator of this invention is provided as a regenerator (cold accumulating unit) for a predetermined cooling stage of the refrigerator while another regenerator (cold accumulating unit) packed with another cold accumulating material having a specific heat characteristic corresponding to a temperature distribution required for the regenerator (cold accumulating unit) is also disposed to another cooling stage of the refrigerator.

According to the regenerator (cold accumulating unit) thus constructed, the regenerator is formed by packing the plate-shaped cold accumulating materials into a regenerator body, and there can be secured the gaps enabling the cooling medium gas (He gas) to easily pass through the cold accumulating material and to perform the sufficient heat exchange between the cooling medium gas and the cold accumulating material. Therefore, even if the regenerator (cold accumulating unit) is used as a regenerator for the refrigerators such as Starling refrigerator and pulse-tube type refrigerator to be operated with a high speed, a pressure loss at the regenerator is small and there can be provided a regenerator (cold accumulating unit) capable of exhibiting a stable refrigerating performance for a long time of period.

Further, when the above regenerator (cold accumulating unit) is used as at least part of the regenerator for the refrigerator, there can be provided a refrigerator having a high refrigerating performance at low temperature range, and capable of maintaining a stable refrigerating performance for a long time.

Furthermore, in an MRI apparatus, a cryopump, a superconducting magnet for magnetic floating train, and a in-magnetic field single crystal pull-up apparatus (magnetic field applied Czochralski), since, in all of them, performance of the refrigerator dominates the performance of each apparatus, an MRI apparatus, a cryopump, a superconducting magnet for magnetic floating train, and an in-magnetic field single crystal pull-up apparatus in which the above described refrigerators are assembled therein can exhibit excellent performances for a long term.

Next, the embodiments of the present invention will be described more concretely with reference to examples mentioned below.

EXAMPLE 1

An alloy ingot having a composition of $HoCu_2$ was prepared by casting a molten alloy melted by utilizing a high-frequency melting method. The ingot was then subjected to a heat treatment in a vacuum atmosphere at a temperature of 750° C. for 12 hours. Thus prepared alloy ingot was then sliced by means of a blade saw thereby to prepare a number of strip-shaped cold accumulating materials 3*a* each having a width W of 35 mm, a length L of 10 mm and a thickness T of 0.5 mm as shown in FIG. 3.

On the other hand, as shown in FIG. 3, there was prepared a cylindrical regenerator body 2*a* having a rectangular-shape in cross-section and inner dimensions of 35 mm×35 mm×150 mm (length). A plurality of grooves 5 each having a depth of 0.5 mm were formed to an inner wall of the regenerator body 2*a* as shown in FIG. 4. Then, both outer peripheral portions of the strip-shaped cold accumulating material 3*a* were inserted into and fixed to the grooves 5 formed to the regenerator body 2*a*, thereby to prepare a regenerator (cold accumulating unit) 1*a* of Example 1.

In the above regenerator (cold accumulating unit) la of Example 1, 15 sheets of the strip-shaped cold accumulating materials 3*a* are continuously arranged in a cooling medium gas flowing direction so that a longitudinal direction of the strip-shaped cold accumulating material 3*a* is coincide with the cooling medium gas flowing direction. Further, a thickness of a projection forming the groove 5 is set to 0.1 mm, a cooling medium gas flowing passage 4 having a gap G of 0.1 mm is formed between the adjacent strip-shaped cold accumulating materials 3*a*, 3*a* arranged in a direction normal to the cooling medium gas flowing direction.

Figure 5:
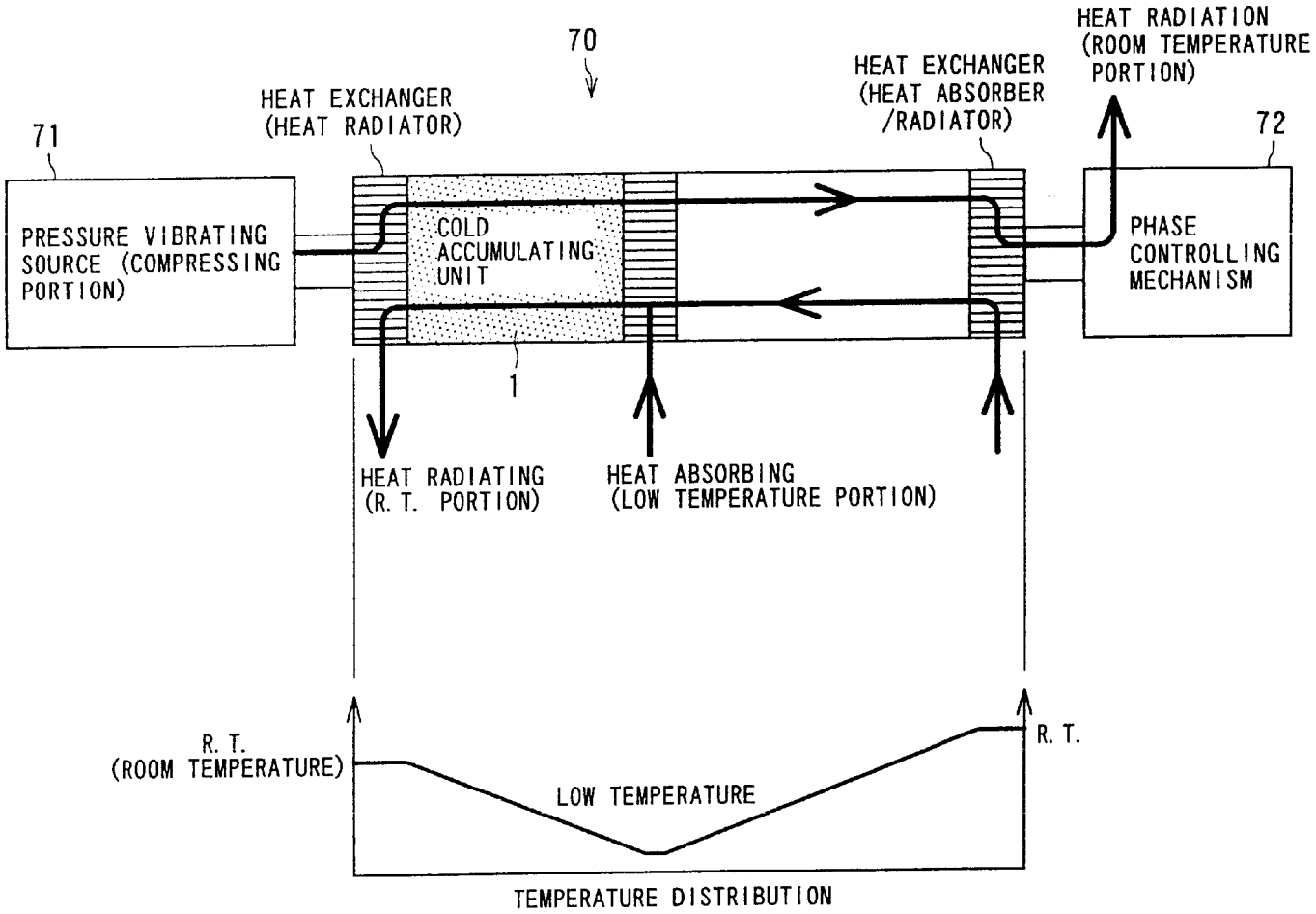
FIG. 5 is a schematic view showing an elemental structure and a temperature distribution in a pulse-tube type refrigerator.

Next, in order to evaluate characteristics of thus prepared regenerator (cold accumulating unit), a pulse-tube type refrigerator having two cooling stages was prepared. A basic structure of a pulse-tube type refrigerator having one cooling stage is shown in FIG. 5. The most characterizing structural feature of this pulse-tube type refrigerator 70 is that the refrigerator 70 do not comprise a reciprocating piston for generating a cold heat though the reciprocating piston is an essential component for GM refrigerator as described later. Therefore, the pulse-tube type refrigerator has advantages of being excellent in mechanical reliability and low-vibration characteristic, so that the pulse-tube type refrigerator has been expected to be used a refrigerator for effectively cooling elements and sensors or the like.

The pulse-tube type refrigerator 70 is classified into one kind of cold accumulation refrigerators and generally uses helium gas as the cooling medium gas. As a basic structure, the refrigerator comprises the regenerator (cold accumulating unit) 1, a pressure vibrating source 71 for compressing the helium gas, and a phase controlling mechanism 72 for controlling a time difference between a pressure-fluctuation and a positional fluctuation (displacement) of the cooling medium gas.

In the GM refrigerator or Starling refrigerator, the above phase controlling mechanism 72 corresponds to a reciprocating piston mechanism provided to a low temperature portion. In contrast, in the pulse-tube type refrigerator 70, the phase controlling mechanism 72 is provided to a room temperature portion, and a low temperature end portion of the regenerator (cold accumulating unit) 1 is connected to the room temperature portion of the phase controlling mechanism 72 through a pipe, so called "pulse-tube", whereby the phase of the pressure-wave of the cooling medium gas is remotely controlled. When a transfer of entropy between cooling medium gas and the cold accumulating material due to the pressure fluctuation is advanced in an appropriate timing with the displacement of the cooling medium gas, the entropy is successively drawn up in one direction, so that a cold heat having a lower temperature can be obtained at the low temperature portion of the regenerator (cold accumulating unit) 1.

Then, the regenerator (cold accumulating unit) of Example 1 as described hereinbefore was assembled as the second regenerator (cold accumulating unit) of the two-staged pulse-tube type refrigerator, thereby to assemble a refrigerator according to Example 1, and a refrigeration test was carried out under a frequency condition of 5 Hz. A refrigerating capacity of the refrigerator at temperature of 4.2K was measured.

Note, the refrigerating capacity in the respective Examples is defined as a heat load at a time when a heat load supplied from a heater is applied to the second cooling stage during the operation of the refrigerator and a temperature rise in the second cooling stage is stopped at 4.2K.

As a result, a refrigerating capacity of 0.11 W at 4.2K was obtained. In addition, after the completion of the refrigerating test, when the cold accumulating material packed in the regenerator (cold accumulating unit) of the refrigerator was took out from the unit and an appearance of the cold accumulating material was observed, any damage was not found at all to the respective plate-shaped cold accumulating materials.

EXAMPLE 2

An alloy ingot having a composition of $HoCu_2$ was prepared by casting a molten alloy melted by utilizing a high-frequency melting method. The ingot was then subjected to a heat treatment in a vacuum atmosphere at a temperature of 750° C. for 12 hours. Thus prepared alloy ingot was then sliced by means of a blade saw thereby to prepare a number of strip-shaped cold accumulating materials 3*b* each having a width of 35 mm, a length of 15 mm and a thickness of 0.7 mm as shown in FIGS. 6 and 7.

On the other hand, as shown in FIGS. 6 and 7, there was prepared a cylindrical regenerator body 2*b* having a rectangular-shape in cross-section and inner dimensions of 35 mm×35 mm×150 mm (length). A plurality of projections 6 each having dimensions of 1 mm×2 mm×0.2 mm (thickness) were formed to an inner wall of the regenerator body 2*b* as shown in FIG. 7. Then, both outer peripheral portions of the strip-shaped cold accumulating material 3*b* were inserted into and fixed to portions between the projections 6, 6 formed to the regenerator body 2*b*, thereby to prepare a regenerator (cold accumulating unit) 1*b* of Example 2.

In the above regenerator (cold accumulating unit) 1*b* of Example 2, 10 sheets of the strip-shaped cold accumulating materials 3*b* are continuously arranged in a cooling medium gas flowing direction so that a longitudinal direction of the strip-shaped cold accumulating material 3*b* is coincide with the cooling medium gas flowing direction. Further, a thickness of the projection 6 is set to 0.2 mm, a cooling medium gas flowing passage having a gap of 0.2 mm is formed between the adjacent strip-shaped cold accumulating materials 3*b*, 3*b* arranged in a direction normal to the cooling medium gas flowing direction.

Then, this regenerator (cold accumulating unit) 1*b* was assembled as the second regenerator of the two-staged pulse-tube type refrigerator, thereby to assemble a refrigerator according to Example 2, and a refrigeration test was carried out under a condition of frequency of 5 Hz as the same as in Example 1. When a refrigerating capacity of the refrigerator at temperature of 4.2K was measured, a refrigerating capacity of 0.10 W was obtained.

EXAMPLE 3

An alloy ingot having a composition of $HoCu_2$ was prepared by casting a molten alloy melted by utilizing a high-frequency melting method. The ingot was then subjected to a heat treatment in a vacuum atmosphere at a temperature of 750° C. for 12 hours. Thus prepared alloy ingot was then sliced by means of a blade saw thereby to prepare a number of strip-shaped cold accumulating materials 3 each having a length of 25 mm and a thickness of 1 mm as shown in FIGS. 8 and 9.

In this case, a width of the respective strip-shaped cold accumulating materials 3 is controlled to be a dimension enabling the cold accumulating materials 3 to be arranged in a circular-cylindrical retainer 7 having an outer diameter of 39 mm and a length of 25 mm so that the cold accumulating materials 3 are arranged in a direction normal to the gas flowing direction so as to provide a predetermined gap therebetween.

The above retainer 7 was prepared so as to have the outer diameter capable of being fitted into the regenerator body 2. The inner surface of the retainer 7 was formed with grooves 5*a* extending in the gas flowing direction, and the grooves 5*a* were used for supporting and fixing the cold accumulating materials 3 by inserting both peripheral portions of the plate-shaped (strip-shaped) cold accumulating materials 3 into the grooves 5*a*. Then, both the peripheral portions of the cold accumulating materials 3 each having a different width were inserted into the grooves 5*a* formed to the retainer 7, and the cold accumulating materials 3 were integrally fixed thereby to assemble a number of the retainers 7. Further, six pieces of thus assembled retainers 7 were packed in a regenerator body 2 having an inner diameter of 39 mm and a length of 150 mm so that the retainers 7 were piled up in an axial direction of the regenerator body 2, thereby to prepare a regenerator (cold accumulating unit) 1*c* of Example 3. In this regard, an angle è constituted by plane surfaces of the adjacent plate-shaped cold accumulating materials 3, 3 was set to zero in a radial direction of the regenerator.

Then, this regenerator (cold accumulating unit) 1*c* was assembled as the second regenerator (cold accumulating unit) of the two-staged pulse-tube type refrigerator as the same as in Example 1, thereby to assemble a refrigerator according to Example 3, and a refrigeration test was carried out under a condition of frequency of 5 Hz. When a refrigerating capacity of the refrigerator at temperature of 4.2K was measured, a refrigerating capacity of 0.13 W was obtained.

EXAMPLE 4

With respect to the regenerator (cold accumulating unit) 1*c* of example 3 formed by piling up six stages of the retainers 7 in which the respective plate-shaped cold accumulating materials 3 were inserted and fixed, each of the retainers 7 of second stage to sixth stage was successively rotated around the center axis of the retainer 7 at 5 degree with respect to the adjacent retainer 7 of the lowest stage. While maintaining the rotated state of the respective retainers 7, the retainers 7 were piled up and packed in the regenerator body in a multi-staged form, thereby to prepare a regenerator (cold accumulating unit) of Example 4.

Namely, the regenerator (cold accumulating unit) of Example 4 was constituted so that the cold accumulating materials 3, 3 packed in the adjacent retainers 7, 7 were displaced to each other in such a manner that the angle è constituted by the plane surface of one plate-shaped cold accumulating material 3 fixed in the retainer 7 of the respective stages and the plane surface of the cold accumulating materials 3 fixed in the adjacent retainer 7 was set to 5° (5 degrees) in a radial direction of the regenerator.

Then, this regenerator (cold accumulating unit) was assembled as the second regenerator (cold accumulating unit) of the two-staged pulse-tube type refrigerator as the same as in Example 1, thereby to assemble a refrigerator according to Example 4, and a refrigeration test was carried out under a condition of frequency of 5 Hz. When a refrigerating capacity of the refrigerator at temperature of 4.2K was measured, the refrigerating capacity of 0.20 W was obtained.

Comparative Example 1

An alloy ingot having a composition of $HoCu_2$ was prepared in accordance with the high frequency melting method. Then, the alloy ingot was melted at a temperature of about 1350K to prepare a molten alloy. The molten alloy was dropped on a rotating disc (rotating speed: $1\times10^4$ rpm) in an Ar atmosphere having a controlled pressure of 90 KPa, and rapidly quenched and solidified thereby to prepare magnetic particles. From thus obtained magnetic particles, the spherical magnetic particles having grain size of 0.2–0.3 mm were selected by sieving method and shape classification. Then, the spherical magnetic particles was packed and filled into a regenerator body having an inner diameter of 35 mm and a length of 150 mm, thereby to prepare a conventional regenerator (cold accumulating unit) of Comparative Example 1.

Then, this regenerator (cold accumulating unit) was assembled as the second regenerator of the two-staged pulse-tube type refrigerator as the same as in Example 1, thereby to assemble a refrigerator according to Comparative Example 1, and a refrigeration test was carried out under a condition of frequency of 5 Hz. When a refrigerating capacity of the refrigerator at temperature of 4.2K was measured, the refrigerating capacity of 0.02 W was obtained.

Comparative Example 2

Figure 11:
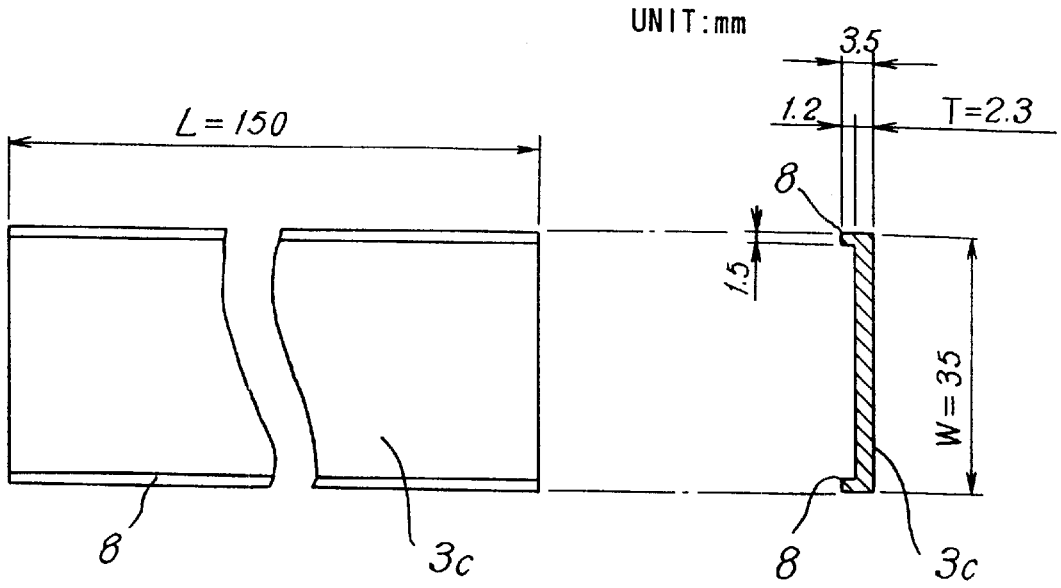
FIG. 11 is a perspective view and a cross sectional view of a conventional cold accumulating material.

An alloy ingot having a composition of $HoCu_2$ was prepared by casting a molten alloy melted by utilizing a high-frequency melting method. The ingot was then subjected to a heat treatment in a vacuum atmosphere at a temperature of 750° C. for 12 hours. Thus prepared alloy ingot was then sliced by means of a blade saw, followed by subjecting to a mechanically grinding work thereby to prepare a number of cold accumulating materials 3*c* each having a width W of 35 mm, a length L of 150 mm and a thickness T of 2.3 mm as shown in FIG. 11. In addition, the cold accumulating material 3*c* was formed with a flange portion 8 having a width of 1.5 mm and a height of 1.2 mm at both peripheral portions thereof, and the flange portion 8 being extended in a longitudinal direction of the regenerator body and having a U-shape in cross section.

Figure 12:
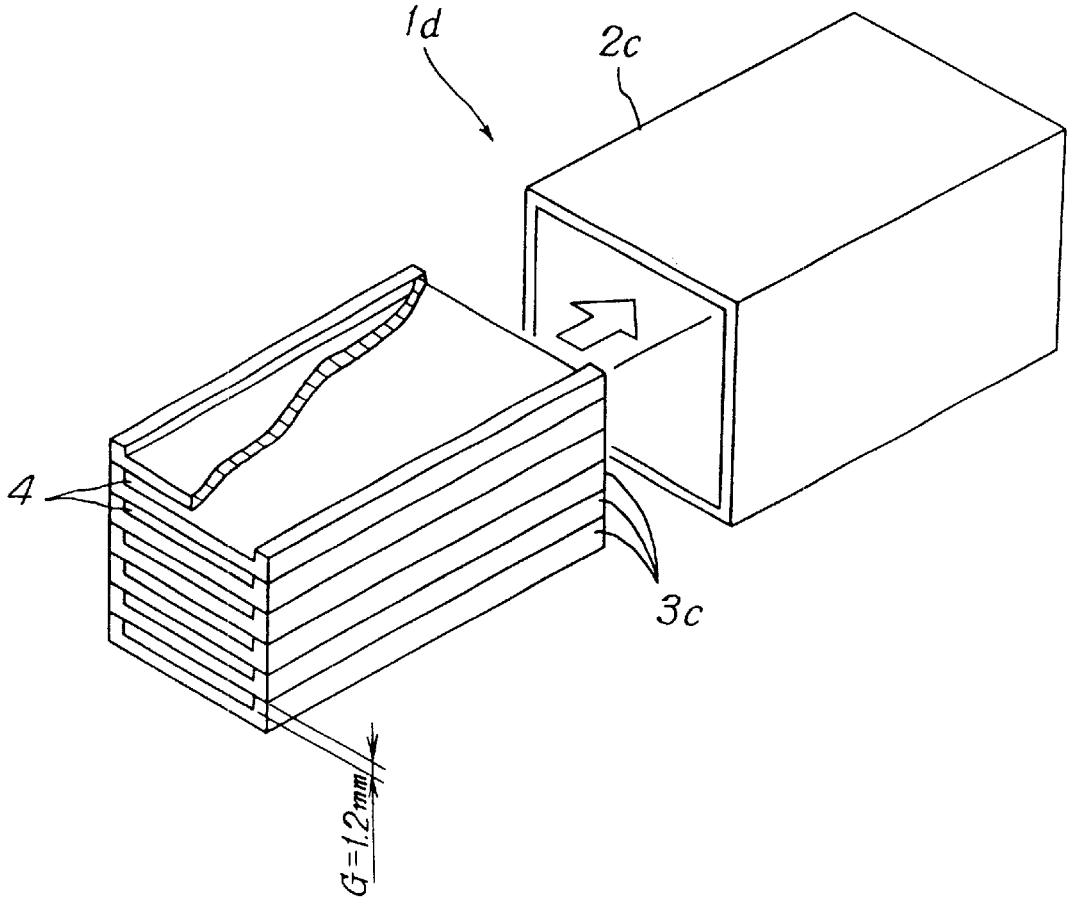
FIG. 12 is a perspective view showing an operation for assembling a regenerator (cold accumulating unit) by stacking the cold accumulating material shown in FIG. 11 and then inserting the stacked materials into a regenerator body.

On the other hand, as shown in FIG. 12, there was prepared a cylindrical regenerator body 2*c* having a rectangular-shape in cross-section and inner dimensions of 35 mm×35 mm×150 mm (length). Then, as shown in FIG. 12, 10 sheets of the plate-shaped cold accumulating materials 3*c* each having U-shape in cross section as prepared above were piled up or stacked. While maintaining the piling structure, the piled materials 3*c* were inserted and fixed into the regenerator body 2*c*, thereby to prepare a regenerator (cold accumulating unit) 1*d* of Comparative Example 2.

In the above regenerator (cold accumulating unit) 1*d* of Comparative Example 2, 10 sheets of the plate-shaped cold accumulating materials 3*c* are arranged so as to extend to an entire length of the regenerator body 2*c*, and so as to be piled up in a direction normal to the cooling medium gas flowing direction. In addition, the flange portions 8 formed to both the peripheral portions of each of the cold accumulating material 3*c* function as spacers for securing the substantial gap between the adjacent cold accumulating materials 3*c*, 3*c*. Since the height of the respective flange portions 8 was set to 1.2 mm, a cooling medium gas flowing passage 4 having a gap G of 1.2 mm is respectively formed between the adjacent plate-shaped cold accumulating materials 3*c*, 3*c* arranged in a direction normal to the cooling medium gas flowing direction.

Then, this regenerator (cold accumulating unit) 1*d* was assembled as the second regenerator of the two-staged pulse-tube type refrigerator, thereby to assemble a refrigerator according to Comparative Example 2, and a refrigeration test was carried out under a condition of frequency of 5 Hz as the same as in Example 1. When a refrigerating capacity of the refrigerator at temperature of 4.2K was measured, only a low refrigerating capacity of 0.04 W was obtained. In addition, it was confirmed that a great amount of working manpower was required for forming the flange portions 8 to the respective cold accumulating materials 3*c*, thus greatly increasing the manufacturing cost of the cold accumulating unit.

EXAMPLE 5

A thickness T of the plate-shaped cold accumulating material 3*a* used in Example 1 was variously changed within a range of 0.1–2.3 mm. Each set of the cold accumulating materials 3*a* each having the same thickness were inserted into a regenerator body having dimensions of 35 mm×35 mm×150 mm (length), followed by being fixed under a condition that a dimension of the gap to be formed between the adjacent plate-shaped cold accumulating materials 3*a*, 3*a* was set to the same as that of Example 1, thereby to prepare the respective regenerators (cold accumulating units) of Example 5.

Then, each of the above regenerators (cold accumulating units) was assembled as the second regenerator of the two-staged pulse-tube type refrigerator, thereby to assemble refrigerators according to Example 5, and a refrigeration test was carried out under a condition of frequency of 5 Hz as the same manner as in Example 1. When a refrigerating capacity of the respective refrigerators at temperature of 4.2K was measured, the results shown in FIG. 13 were obtained.

Figure 13:
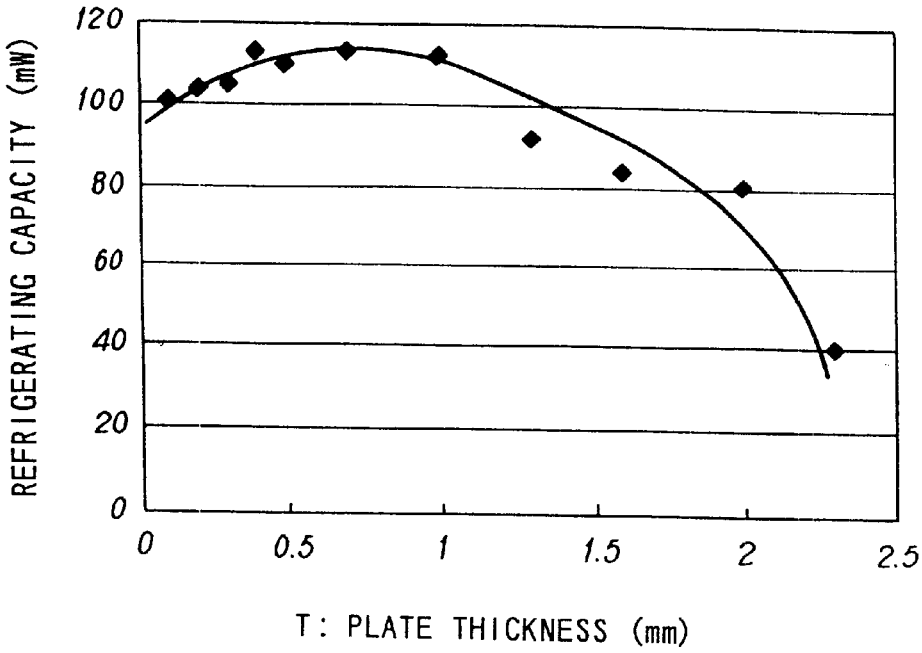
FIG. 13 is a graph showing a relationship between a thickness of a plate-shaped cold accumulating material and a capacity of a refrigerator.

As is clear from the results shown in FIG. 13, in case of the refrigerators using the cold accumulating material having a thickness of 0.4 mm or less, it was confirmed that a significant difference in refrigerating capacity was not observed, while it became more difficult to assemble the cold accumulating materials into the regenerator body with decreasing the thickness of the material. From the results shown in FIG. 13, it was confirmed that a high refrigerating capacity was effectively obtained when the cold accumulating materials having a thickness range of 0.4–2 mm were used.

EXAMPLE 6

A dimension of the gap G between the adjacent plate-shaped cold accumulating materials 3*a*, 3*a* each having a thickness of 0.5 mm used in Example 1 was variously changed within a range of 0.08–1.5 mm. Namely, the cold accumulating materials 3*a* were inserted into a regenerator body having dimensions of 35 mm×35 mm×150 mm (length), followed by being fixed under a condition that a dimension of the gap to be formed between the adjacent plate-shaped cold accumulating materials 3*a*, 3*a* was set to the above range, thereby to prepare the respective regenerators (cold accumulating units) of Example 6 each having a different dimension of the gap G.

Then, each of the above regenerators (cold accumulating units) was assembled as the second regenerator of the two-staged pulse-tube type refrigerator, thereby to assemble refrigerators according to Example 6, and a refrigeration test was carried out under a condition of frequency of 5 Hz as the same manner as in Example 1. When a refrigerating capacity of the respective refrigerators at temperature of 4.2K was measured, the results shown in FIG. 14 were obtained.

Figure 14:
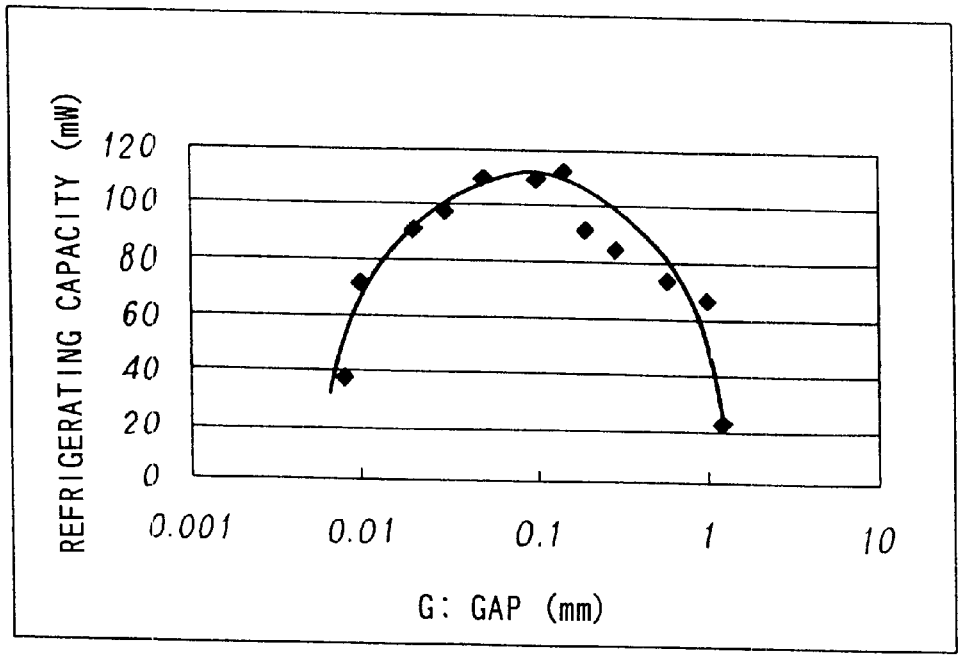
FIG. 14 is a graph showing a relationship between a size of a gap between adjacent plate-shaped cold accumulating materials and a capacity of a refrigerator.

As is clear from the results shown in FIG. 14, in case of the refrigerators using the regenerators (cold accumulating units) in which the gaps G of the adjacent plate-shaped cold accumulating materials were set to within a range of 0.01–1 mm, it was confirmed that each of the refrigerators exhibited a peak of refrigerating capacity. Particularly, when the cold accumulating units of which gaps were set to within a range of 0.05–0.5 mm were used, it was confirmed that a high refrigerating capacity was effectively obtained.

EXAMPLE 7

An alloy ingot having a composition of $Er_3Ni$ was prepared by casting a molten alloy melted by utilizing a high-frequency melting method. The ingot was then subjected to a heat treatment in a vacuum atmosphere at a temperature of 700° C. for 12 hours. Thus prepared alloy ingot was then sliced by means of a blade saw thereby to prepare a number of strip-shaped cold accumulating materials each having a width W of 40 mm, a length L of 15 mm and a thickness T of 0.6 mm.

On the other hand, there was prepared a cylindrical regenerator body having a rectangular-shape in cross-section and inner dimensions of 40 mm×40 mm×180 mm (length). A plurality of grooves each having a depth of 0.6 mm were formed to an inner wall of the regenerator body. Then, both outer peripheral portions of the strip-shaped cold accumulating material were inserted into and fixed to the grooves formed to the regenerator body, thereby to prepare a regenerator (cold accumulating unit) of Example 7.

In the above regenerator (cold accumulating unit) of Example 7, 12 sheets of the strip-shaped cold accumulating materials are continuously arranged in a cooling medium gas flowing direction so that a longitudinal direction of the strip-shaped cold accumulating material is coincide with the cooling medium gas flowing direction. Further, a thickness of a projection forming the groove is set to 0.08 mm, a cooling medium gas flowing passage having a gap G of 0.08 mm is formed between the adjacent strip-shaped cold accumulating materials arranged in a direction normal to the cooling medium gas flowing direction.

Figure 15:
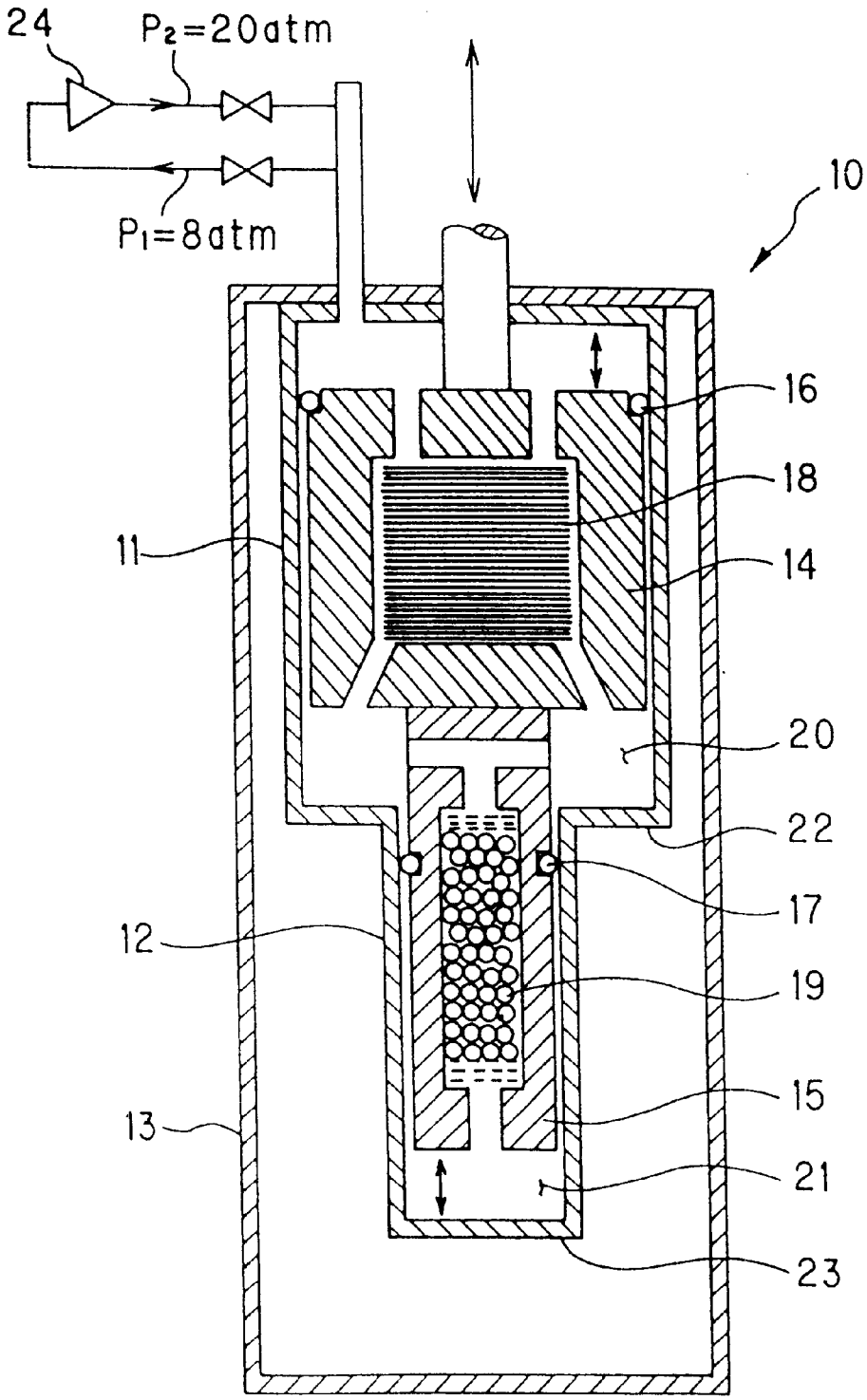
FIG. 15 is a cross sectional view showing an essential portion of a cold accumulation refrigerator (GM refrigerator) according to the present invention.

In order to evaluate the characteristics of the regenerator (cold accumulating unit) as prepared above, there was prepared a two-staged expansion type GM refrigerator as shown in FIG. 15. In this regard, the two-staged expansion type GM refrigerator 10 shown in FIG. 15 is one embodiment of a refrigerator of this invention.

The two-staged expansion type GM refrigerator 10 shown in FIG. 15 has a vacuum container 13 containing a first cylinder 11 having a large diameter and a second cylinder 12 having a small diameter, which is connected coaxially to the first cylinder 11. The first cylinder 11 contains a first regenerator (cold accumulating unit) 14 which is freely reciprocatable and the second cylinder 12 also contains a second regenerator (cold accumulating unit) 15 which is freely reciprocatable. Seal rings 16, 17 are disposed between the first cylinder 11 and first regenerator (cold accumulating unit) 14, and between the second cylinder 12 and second regenerator (cold accumulating unit) 15, respectively.

The first regenerator (cold accumulating unit) 14 accommodates a first cold accumulating material 18 made of Cu mesh or the like. The low temperature side of the second regenerator (cold accumulating unit) 15 contains a second cold accumulating material 19 for extremely low temperature cold used in a regenerator (cold accumulating unit) of this invention. The first regenerator (cold accumulating unit) 14 and second regenerator 15 have operating medium (cooling medium gas or refrigerant) passages for He gas or the like which are provided in gaps of the first cold accumulating material 18 and cold accumulating material 19 for extremely low temperature.

A first expansion chamber 20 is provided between the first regenerator (cold accumulating unit) 14 and second regenerator (cold accumulating unit) 15. A second expansion chamber 21 is provided between the second regenerator 15 and an end wall of the second cylinder 12. A first cooling stage 22 is provided on a bottom of the first expansion chamber 20 and further a second cooling stage 23 which is colder than the first cooling stage 22 is provided on a bottom of the second expansion chamber 21.

A highly pressurized operating medium (cooling medium gas e.g., He gas) is supplied from a compressor 24 to the aforementioned two-staged GM refrigerator 10. The supplied operating medium passes through the first cold accumulating material 18 accommodated in the first regenerator 14 and reaches the first expansion chamber 20, and further passes through the cold accumulating material for extremely low temperature (second cold accumulating material) 19 accommodated in the second regenerator 15 and reaches the second expansion chamber 21. At this time, the operating medium supplies heat energy to the respective first cold accumulating materials 18, 19, so that the materials are cooled.

The operating medium passing through the respective cold accumulating materials 18, 19 is expanded in the respective expansion chambers 20, 21 so as to produce cool atmosphere thereby cooling the respective cooling stages 22, 23. The expanded operating medium flows in the respective cold accumulating materials 18, 19 in opposite direction. The operating medium receives heat energy from the respective cold accumulating materials 18, 19 and is discharged. As recuperation effect is improved in this process, the refrigerator is constructed so that the heat efficiency of the operating medium cycle is improved whereby a further lower temperature is realized.

Then, thus prepared cold accumulating unit of Example 7 was assembled as the second regenerator of the two-staged expansion type GM refrigerator, thereby to assemble a refrigerator according to Example 7, and a refrigeration test was carried out under a frequency condition of 2 Hz. When a refrigerating capacity of the refrigerator at temperature of 4.2K was measured, the refrigerating capacity of 0.57 W was obtained. In addition, after the completion of the refrigerating test, when the cold accumulating material packed in the regenerator (cold accumulating unit) of the refrigerator was took out from the unit and an appearance of the material was observed, any damage was not found at all to the plate-shaped cold accumulating material.

Comparative Example 3

An alloy ingot having a composition of $Er_3Ni$ was prepared in accordance with the high frequency melting method. Then, the alloy ingot was melted at a temperature of about 1200K to prepare a molten alloy. The molten alloy was dropped on a rotating disc (rotating speed: $1\times10^4$ rpm) in an Ar atmosphere having a controlled pressure of 90 KPa, and rapidly quenched and solidified thereby to prepare magnetic particles. From thus obtained magnetic particles, the spherical magnetic particles having grain size of 0.2–0.3 mm were selected by sieving method and shape classification. Then, the spherical magnetic particles was packed and filled into a cylindrical regenerator body having a rectangular shape in cross section and having dimensions of 40 mm×40 mm×180 mm (length) as the same manner as in Example 7, thereby to prepare a conventional regenerator (cold accumulating unit) of Comparative Example 3.

Then, this regenerator (cold accumulating unit) was assembled as the second regenerator of the two-staged expansion type GM refrigerator as the same manner as in Example 7, thereby to assemble a GM refrigerator according to Comparative Example 3, and a refrigeration test was carried out under a condition of frequency of 2 Hz. When a refrigerating capacity of the refrigerator at temperature of 4.2K was measured, the refrigerating capacity of 0.21 W was obtained.

Next, another embodiment will be explained with reference to the following regenerators (cold accumulating units) in a plurality of plate-shaped cold accumulating materials are arranged so as to partition a cross sectional area of a flowing passage of the cooling medium gas, thereby to form a plurality of cells through which the cooling medium gas flows.

EXAMPLE 8

An alloy ingot having a composition of $HoCu_2$ was prepared in accordance with the high frequency melting method. Then, the $HoCu_2$ alloy ingot was pulverized by means of a jet-mill to prepare a cold accumulating material powder having an average grain size of 2.6 $\mu$m. Then, polyvinyl alcohol (PVA) and water were added to thus prepared cold accumulating material powder and uniformly mixed to prepare a material mixture. Thereafter, the material mixture was supplied to a screw-type extrusion machine comprising a metal mold (dies) having a cross-sectional area of cells shown in FIG. 10B, and an extrusion molding was carried out thereby to obtain an extruded product formed with cells each having a predetermined cross- sectional area. The cross sectional shape of the respective cells was a square shape of which side length was 50 $\mu$m, and a thickness of the cold accumulating material as a partition wall for enclosing the cell was 100 $\mu$m. After the extruded product was degreased, the degreased product was sintered at a temperature of 850° C. thereby to prepare a cold accumulating material for Example 8 having a diameter of 35 mm and a length of 30 mm.

Three pieces of the cold accumulating materials each having the above cell structure were packed into a low-temperature side of a regenerator body having a length of 150 mm, while the remaining space of the regenerator body at a high-temperature side thereof was filled with a powder composed of spherical Pb particles having a grain size of 180–300 $\mu$m through a spacer composed of felt, thereby to prepare the regenerator (cold accumulating unit) according to Example 8.

Then, thus prepared regenerator (cold accumulating unit) of Example 8 was assembled as the second regenerator of the two-staged pulse-tube type refrigerator as shown in FIG. 5, thereby to assemble a refrigerator according to Example 8, and the pulse-tube type refrigerator was operated to carry out a refrigerating test under a frequency condition of 6 Hz. When a refrigerating capacity of the refrigerator at temperature of 4.2K was measured, the refrigerating capacity was stable to be 0.15 W. In addition, after the completion of the refrigerating test, when the cold accumulating material packed in the regenerator (cold accumulating unit) of the refrigerator was took out from the regenerator and an appearance of the cold accumulating material having the cell structure was observed, any damage such as broken partition wall was not observed at all to the cold accumulating. material.

EXAMPLE 9

A $GdAlO_3$ powder having an average grain size of 1.8 μm was prepared as cold accumulating material powder. Then, polyvinyl alcohol (PVA) and water were added to thus prepared cold accumulating material powder and uniformly mixed to prepare a material mixture. Thereafter, the material mixture was supplied to a screw-type extrusion machine comprising a metal mold (dies) having a cross-sectional area of cells shown in FIG. 10B, and an extrusion molding was carried out thereby to obtain an extruded product formed with cells each having a predetermined cross-sectional area. The cross sectional shape of the respective cells was a square shape of which side length was 50 μm, and a thickness of the cold accumulating material as a partition wall for enclosing the cell was 100 μm. After the extruded product was degreased, the degreased product was sintered at a temperature of 1500° C. thereby to prepare a cold accumulating material for Example 9 having a diameter of 35 mm and a length of 30 mm.

One piece of the cold accumulating materials each having the above cell structure was packed into a low-temperature side of a cold accumulating unit body having a length of 150 mm, while the remaining space of the cold accumulating unit body at a high-temperature side thereof was packed with two pieces of the cold accumulating material prepared in Example 8, further, the still remaining space of the unit at higher-temperature thereof was filled with a powder composed of spherical Pb particles having a grain size of 180–300 μm through a spacer composed of felt, thereby to prepare the regenerator (cold accumulating unit) according to Example 9.

Then, thus prepared regenerator (cold accumulating unit) of Example 9 was assembled as the second regenerator of the two-staged pulse-tube type refrigerator as shown in FIG. 5, thereby to assemble a refrigerator according to Example 9, and the pulse-tube type refrigerator was operated to carry out a refrigerating test under a frequency condition of 6 Hz. When a refrigerating capacity of the refrigerator at temperature of 4.2K was measured, the refrigerating capacity was stable to be 0.18 W. In addition, after the completion of the refrigerating test, when the cold accumulating material packed in the regenerator of the refrigerator was took out from the unit and an appearance of the cold accumulating material having the cell structure was observed, any damage such as broken partition wall was not observed at all.

Comparative Example 4

An alloy ingot having a composition of $HoCu_2$ was prepared in accordance with the high frequency melting method. Then, the $HoCu_2$ alloy ingot was melted at a temperature of about 1350K to prepare a molten alloy. The molten alloy was dropped on a rotating disc (rotating speed: $1\times10^4$ rpm) in an argon atmosphere having a controlled pressure of 90 KPa, and rapidly quenched and solidified thereby to prepare magnetic particles. From thus obtained magnetic particles, the spherical magnetic particles having grain size of 0.2–0.3 mm were selected by sieving method and shape classification thereby to prepare a cold accumulating material particles for Comparative Example 4.

Then, these spherical magnetic particles were packed and filled into a regenerator body of the pulse-tube type refrigerator used in Examples 8 and 9, thereby to prepare a conventional regenerator (cold accumulating unit) of Comparative Example 4. Then, this regenerator (cold accumulating unit) was assembled as the second regenerator of the two-staged pulse-tube type refrigerator shown in FIG.5, thereby to assemble a refrigerator according to Comparative Example 4, and a refrigeration test was carried out under a condition of frequency of 6 Hz. When a refrigerating capacity of the refrigerator at temperature of 4.2K was measured, the refrigerating capacity was 0.01 W.

As described above, according to the regenerators (cold accumulating units) of the respective Examples, even if the regenerator is used as a regenerator (cold accumulating unit) for the refrigerators such as pulse-tube type refrigerator and Starling refrigerator to be operated with a high speed, a pressure loss at the regenerator (cold accumulating unit) is small, so that a regenerator having a high heat-exchanging efficiency can be realized whereby there can be provided a cold accumulation refrigerator having a high refrigerating capacity.

EXAMPLE 10

The material mixture of the cold accumulating material powder, polyvinyl alcohol and water was treated and extruded as the same manner as in Example 8 except that the extrusion machine used a molding dies for forming cells each having a triangular cross-section of which one side length is 75 μm as shown in FIG. 10A, thereby to prepare a cold accumulating material having a predetermined cell structure for Example 10. Then, as the same manner as in Example 8, the cold accumulating material was packed in the regenerator body thereby to prepare a regenerator (cold accumulating unit) according to Example 10. Thereafter, the regenerator was assembled in the pulse-tube type refrigerator and a refrigerating test was carried out.

As a result, the refrigerating capacity at 4.2K was 0.14 W. In addition, after the pulse-tube type refrigerator was continuously operated for 500 hours, the refrigerating capacity at 4.2K was again measured. As a result, the refrigerator exhibited a stable characteristic so as to obtain a refrigerating capacity of 0.14 W. Furthermore, after the completion of the refrigerating test, when the cold accumulating material packed in the regenerator (cold accumulating unit) of the refrigerator was took out from the unit and an appearance of the cold accumulating material having the cell structure was observed, however, any damage such as broken partition wall was not observed at all.

EXAMPLE 11

The material mixture of the cold accumulating material powder, polyvinyl alcohol and water was treated and extruded as the same manner as in Example 8 except that the extrusion machine used a molding dies for forming cells each having a circular cross-section as shown in FIG. 10D and a thickness of a partition wall forming the cells was set to 90 μm, thereby to prepare a cold accumulating material having a predetermined cell structure for Example 11. Then, as the same manner as in Example 8, the cold accumulating material was packed in the regenerator body thereby to prepare a regenerator (cold accumulating unit) according to Example 11. Thereafter, the regenerator was assembled in the pulse-tube type refrigerator and a refrigerating test was carried out.

As a result, the refrigerating capacity at 4.2K was 0.11 W. In addition, after the pulse-tube type refrigerator was continuously operated for 500 hours, the refrigerating capacity at 4.2K was again measured. However, the refrigerating capacity was lowered to be 0.05 W. Furthermore, after the completion of the refrigerating test, when the cold accumulating material packed in the regenerator of the refrigerator was took out from the regenerator and an appearance of the cold accumulating material having the cell structure was observed, a breakage of the partition wall was observed at 19 portions of the cold accumulating material and a finely pulverized cold accumulating material was also detected.

Next, embodiments of a super-conductive MRI apparatus, a super-conducting magnet for magnetic floating train, a cryopump, and an in-magnetic field type single crystal pull-up apparatus of the present invention, will be described.

Figure 16:
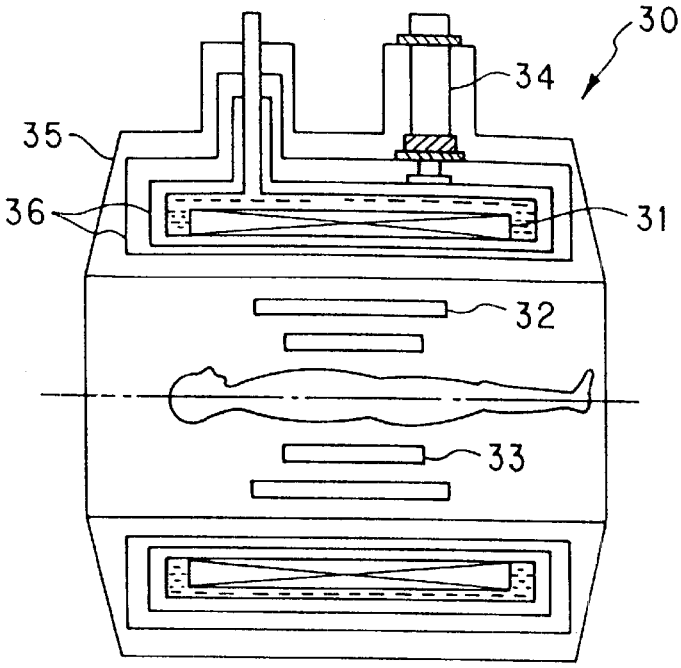
FIG. 16 is a cross sectional view outlining the structure of a super-conductive MRI apparatus according to one embodiment of the present invention.

FIG. 16 is a cross sectional view outlining a structure of a super-conductive MRI apparatus to which the present invention is applied. The super-conductive MRI apparatus 30 shown in FIG. 16 is constituted of a super-conductive magneto-static field coil 31 for biasing a spatially homogeneous and a temporally stable magneto-static field to a human body, a not shown compensating coil for compensating inhomogeneity of generating magnetic field, a gradient magnetic field coil 32 for providing a magnetic field gradient in a measuring region, and a probe for radio wave transducer 33. And, to cool the super-conductive magneto-static field coil 31, the above described cold accumulation refrigerator 34 of the present invention is employed. Incidentally, in the figure, numeral 35 denotes a cryostat, numeral 36 denotes a radiation shield.

In the super-conductive MRI apparatus 30 wherein a cold accumulation refrigerator 34 of the present invention is applied, since an operating temperature of the super-conductive magneto-static field coil 31 can be guaranteed to be stable over a long term, a spatially homogeneous and temporally stable magneto-static field can be obtained over a long term. Therefore, performance of a super-conductive MRI apparatus 30 can be exhibited with stability over a long term.

Figure 17:
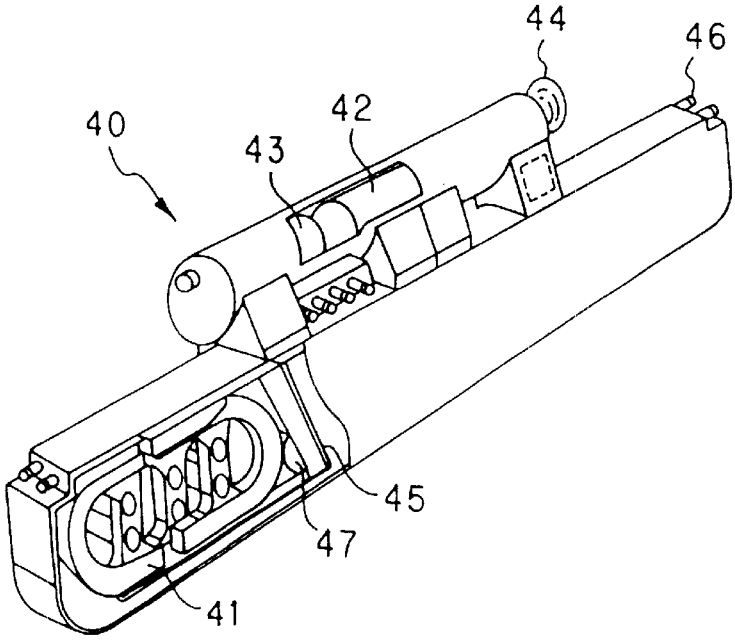
FIG. 17 is a perspective view outlining the essential structure of a super-conducting magnet (for magnetic floating train) according to one embodiment of the present invention.

FIG. 17 is a perspective view outlining a structure of an essential portion of a super-conducting magnet for magnetic floating train (magnetic levitation train) in which the cold accumulation refrigerator of the present invention is applied, a portion of a super-conductive magnet 40 for a magnetic floating train being shown. The super-conductive magnet 40 for a magnetic floating train shown in FIG. 17 is constituted of a super-conductive coil 41, a liquid helium tank 42 for cooling the super-conductive coil 41, a liquid nitrogen tank 43 for preventing evaporation of the liquid helium and a cold accumulating type refrigerator 44 of the present invention. Incidentally, in the figure, numeral 45 denotes a laminated adiathermic material, numeral 46 denotes a power lead, numeral 47 denotes a persistent current switch.

In a super-conductive magnet 40 for a magnetic floating train wherein a cold accumulation refrigerator 44 of the present invention is employed, since the operation temperature of the super-conductive coil 41 can be guaranteed to be stable over a long term, a magnetic filed necessary for magnetic levitation and propulsion of a train can be obtained over a long term with stability. In particular, although acceleration operates in the super-conductive magnet 40 for a magnetic floating (levitation) train, the cold accumulation refrigerator 44 of the present invention, being able to maintain an excellent refrigeration performance over a long term even when the acceleration is operated, can remarkably contribute to the long term stability of the magnetic field and the like. Therefore, a magnetic floating train in which such a super-conductive magnet 40 is employed can exhibit its reliability over a long term.

Figure 18:
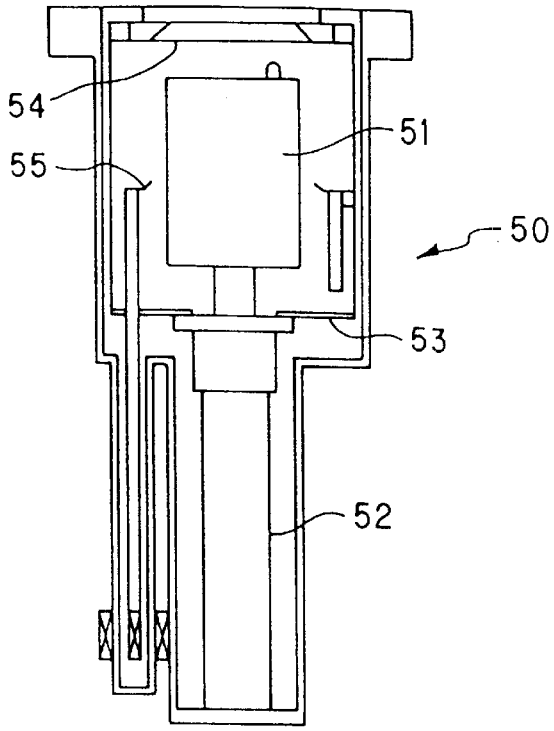
FIG. 18 is a cross sectional view outlining the structure of a cryopump according to one embodiment of the present invention.

FIG. 18 is a cross sectional view outlining a structure of a cryopump to which a cold accumulation refrigerator of the present invention is applied. A cryopump 50 shown in FIG. 18 is constituted of a cryopanel 51 for condensing or absorbing gas molecules, a cold accumulation refrigerator 52 of the present invention for cooling the cryopanel 51 to a predetermined extremely low temperature, a shield 53 disposed therebetween, a baffle 54 disposed at an intake nozzle, and a ring 55 for varying exhaust speed of Argon, nitrogen, hydrogen gas or the like.

With a cryopump 50 involving the cold accumulation refrigerator 52 of the present invention, the operating temperature of the cryopanel 51 can be guaranteed to be stable over a long term. Therefore, the performance of the cryopump 50 can be exhibited over a long term with stability.

Figure 19:
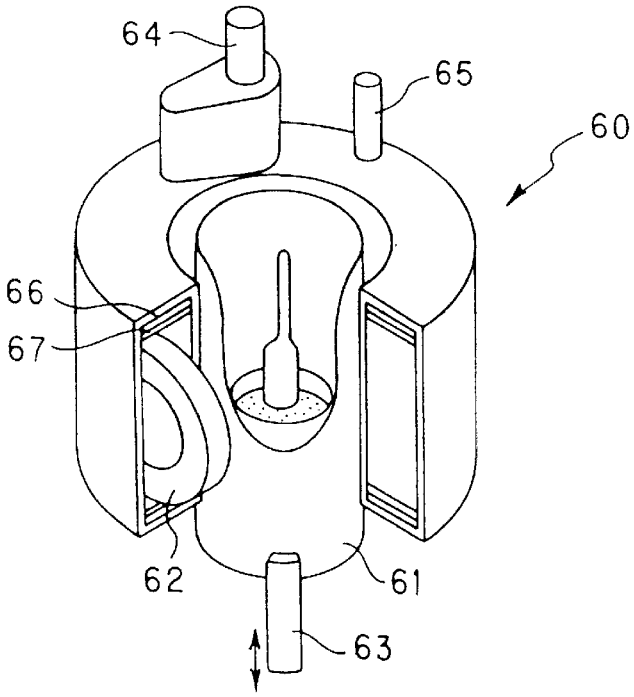
FIG. 19 is a perspective view outlining the essential structure of an in-magnetic field type single crystal pull-up apparatus (magnetic field applied Czocralski) according to one embodiment of the present invention.

FIG. 19 is a perspective view outlining a structure of an in-magnetic field type single crystal pull-up apparatus involving the cold accumulation refrigerator of the present invention. The in-magnetic field type single crystal pull-up apparatus 60 shown in FIG. 19 is constituted of a crucible for melting raw material, a heater, a single crystal pull-up portion 61 possessing a mechanism of pulling up a single crystal, a super-conductive coil 62 for applying a magneto-static field to a raw material melt, and an elevation mechanism 63 of the single crystal pulling up portion 61. And, as a cooling means of the super-conductive coil 62, the above described cold accumulation type refrigerator 64 of the present invention is employed. Now, in the figure, numeral 65 denotes a current lead, numeral 66 denotes a heat shielding plate, numeral 67 denotes a helium container.

With the in-magnetic field type single crystal pull-up apparatus (magnetic field applied Czochralski) 60 involving a cold accumulation refrigerator 64 of the present invention, since the operating temperature of the super-conductive coil 62 can be guaranteed to be stable over a long term, a good magnetic field for suppressing convection of the raw material melt of the single crystal can be obtained over a long term. Therefore, the performance of the in-magnetic field application type single crystal pull-up apparatus 60 can be exhibited with stability over a long term.

As is evident from the above described embodiments, according to the regenerator (cold accumulating unit) of the present invention, the regenerator is formed by packing the plate-shaped cold accumulating materials into a regenerator body, and there can be secured the gaps enabling the cooling medium gas (He gas) to easily pass through the cold accumulating material and to perform the sufficient heat exchange between the cooling medium gas and the cold accumulating material. Therefore, even if the regenerator (cold accumulating unit) is used as a regenerator for the refrigerators such as Starling refrigerator and pulse-tube type refrigerator to be operated with a high speed, a pressure loss at the regenerator (cold accumulating unit) is small and there can be provided a regenerator (cold accumulating unit) capable of exhibiting a stable refrigerating performance for a long time of period.

Further, when the above regenerator (cold accumulating unit) is used as at least part of the regenerator for the refrigerator, there can be provided a refrigerator having a high refrigerating performance at low temperature range, and capable of maintaining a stable refrigerating performance for a long time.

Furthermore, in an MRI apparatus, a cryopump, a super-conducting magnet for magnetic floating train, and a in-magnetic field single crystal pull-up apparatus (magnetic field applied Czochralski), since, in all of them, performance of the refrigerator dominates the performance of each apparatus, an MRI apparatus, a cryopump, a super-conducting magnet for magnetic floating train, and an in-magnetic field single crystal pull-up apparatus in which the above described refrigerators are assembled therein can exhibit excellent performances for a long term.

What is claimed is:

1. A regenerator comprising a regenerator body and cold accumulating material packed in said regenerator body in which cooling medium gas flows from one end portion of the regenerator body to the other end portion of the regenerator body so as to obtain a lower temperature, wherein at least part of the cold accumulating material is a plate-shaped cold accumulating material having a thickness of 0.03–2 mm.

2. A regenerator according to claim 1, wherein said cold accumulating material is composed of an alloy containing 10 at % or more of rare earth element.

3. A regenerator according to claim 1, wherein a length of the plate-shaped cold accumulating material in a flowing direction of the cooling medium gas is 1–100 mm.

4. A regenerator according to claim 1, wherein a plurality of said plate-shaped cold accumulating material are arranged in a direction normal to the cooling medium gas flowing direction so as to form gaps therebetween, and a width of the gap is 0.01–1 mm.

5. A regenerator according to claim 1, wherein grooves are formed to an inner surface of said regenerator body, and a peripheral portion of said plate-shaped cold accumulating material is inserted in the groove.

6. A regenerator according to claim 1, wherein projections are formed to an inner surface of said regenerator body, and a peripheral portion of said plate-shaped cold accumulating material is inserted into a portion between the projections.

7. A regenerator according to claim 1, wherein a plurality of said plate-shaped cold accumulating materials are fixed by a retainer, and the retainer is inserted in the regenerator body.

8. A regenerator according to claim 1, wherein a plurality of said plate-shaped cold accumulating materials are arranged in a cooling medium gas flowing direction, and an angle constituted by a plane surface of the plate-shaped cold accumulating material and a plane surface of adjacent plate-shaped cold accumulating material arranged in a cooling medium gas flowing direction is 0.5° or more in a radial direction of the regenerator.

9. A regenerator according to claim 1, a plurality of said plate-shaped cold accumulating materials are arranged so as to partition a cross sectional area of a flowing passage of the cooling medium gas, thereby to form a plurality of cells through which the cooling medium gas flows.

10. A regenerator according to claim 9, wherein said cold accumulating material forming the cell has an average thickness of 0.05–2 mm.

11. A regenerator according to claim 9, wherein a plurality of said cells have an average cross-sectional area of $1\times10^{-9}$ $m^2$ to $2\times10^{-6}$ $m^2$.

12. A regenerator according to claim 9, wherein a plurality of said cells have an average length of 3 mm to 100 mm.

13. A regenerator according to claim 9, wherein a plurality of said plate-shaped cold accumulating materials and the cells are formed through an extrusion of a mixture comprising cold accumulating material powder and a binder.

14. A cold accumulation refrigerator comprising a regenerator filled with a cold accumulating material through which a cooling medium gas flows from a high temperature upstream side of the cold accumulating unit, so that heat is exchanged between the cooling medium gas and the cold accumulating material thereby to obtain a lower temperature at a downstream side of the regenerator, wherein at least part of the regenerator is composed of the regenerator as set forth in claim 1.

15. A super-conducting magnet comprising a cold accumulation refrigerator as set forth in claim 14.

16. An MRI (Magnetic Resonance Imaging) apparatus comprising a cold accumulation refrigerator as set forth in claim 14.

17. A cryopump comprising a cold accumulation refrigerator as set forth in claim 14.

18. An in-magnetic field single crystal pull-up apparatus comprising a cold accumulation refrigerator as set forth in claim 14.

* * * * *